US005258270A

United States Patent [19]

Kobayashi et al.

[11] Patent Number: 5,258,270

[45] Date of Patent: Nov. 2, 1993

[54] SILVER HALIDE COLOR PHOTOGRAPHIC MATERIAL

[75] Inventors: Hidetoshi Kobayashi; Hiroo Takizawa; Yoshio Ishii, all of Kanagawa, Japan

[73] Assignee: Fuji Photo Film Co., Ltd., Kanagawa, Japan

[21] Appl. No.: 770,810

[22] Filed: Oct. 4, 1991

[30] Foreign Application Priority Data

Oct. 4, 1990 [JP] Japan ..... 2-267041
Oct. 9, 1990 [JP] Japan ..... 2-272025

[51] Int. Cl.[5] ..... G03C 1/46

[52] U.S. Cl. ..... 430/503; 430/505; 430/553; 430/552; 430/557; 430/558

[58] Field of Search ..... 430/503, 505, 552, 553, 430/557, 558

[56] References Cited

U.S. PATENT DOCUMENTS

| | | | |
|---|---|---|---|
| 3,767,411 | 10/1973 | Kishimoto et al. | 430/552 |
| 3,811,890 | 5/1974 | Ohta et al. | 430/508 |
| 4,288,532 | 9/1981 | Seoka et al. | 430/553 |
| 4,358,532 | 11/1982 | Koyama et al. | 430/505 |
| 4,585,731 | 4/1986 | Kobayashi et al. | 430/555 |
| 4,960,685 | 10/1990 | Bowne | 430/553 |
| 4,963,465 | 10/1990 | Matejee et al. | 430/505 |
| 5,019,490 | 5/1991 | Kobayashi et al. | 430/555 |
| 5,023,169 | 6/1991 | Hirabayashi et al. | 430/505 |
| 5,126,235 | 6/1992 | Hioki | 430/550 |

FOREIGN PATENT DOCUMENTS

| | | | |
|---|---|---|---|
| 2152336 | 10/1971 | Fed. Rep. of Germany | 430/552 |
| 46-554 | 1/1971 | Japan | 430/552 |
| 62-87959 | 4/1987 | Japan . | |
| 64-955 | 1/1989 | Japan | 430/553 |

OTHER PUBLICATIONS

RD 18732 (Nov. 1979) pp. 634–638.

*Primary Examiner*—Charles L. Bowers, Jr.
*Assistant Examiner*—Martin Angebranndt
*Attorney, Agent, or Firm*—Sughrue, Mion, Zinn, Macpeak & Seas

[57] ABSTRACT

A silver halide color photographic material having on a support at least one cyan dye-forming coupler-containing silver halide emulsion layer, at least one magenta dye-forming coupler-containing silver halide emulsion layer and at least one yellow dye-forming coupler-containing silver halide emulsion layer, wherein the cyan dye-forming coupler is a 1-naphthol type coupler having a naphtol nucleus, in which a group represented by the following formula (I) binds directly to the 2-position of the naphthol nucleus, and the magenta dye-forming coupler is a 1H-pyrazolo[1,5-b]-1,2,4-triazole type coupler, (I)

wherein $R^1$ represents a hydrogen atom, an alkyl group, an alkenyl group, an alkynyl group, a cycloalkyl group, an aralkyl group, or an aryl group; $R^2$ represents a substituent group; $R^3$ and $R^4$ each represents a hydrogen atom, an alkyl group, an aryl group, a halogen atom, an alkoxy group, or an aryloxy group; l represents an integer from 0 to 4; and m represents an integer from 0 to 4.

9 Claims, No Drawings

SILVER HALIDE COLOR PHOTOGRAPHIC MATERIAL

FIELD OF THE INVENTION

This invention relates to a color photographic material and, more particularly, to a color photographic material which is excellent in color reproduction, and improves the keeping quality of a magenta color image.

BACKGROUND OF THE INVENTION

Formation of dye images in a silver halide color photographic material is, in general, effected by the coupling reaction of the oxidation product of an aromatic primary amine color developing agent, which is formed when the silver halide grains in an optically exposed silver halide color photographic material are reduced by the color developing agent, with couplers incorporated in advance into the silver halide color photographic material. Since colors are generally reproduced by a subtractive color process, three kinds of couplers capable of forming yellow, magenta and cyan dyes, respectively, are used.

Factors affecting color reproduction include the spectral sensitivities of the photosensitive picture-taking material, the correspondence of the spectral sensitivities of the photosensitive printing material to the spectral absorption characteristics of the yellow, magenta and cyan dyes formed in the photosensitive picture-taking material, and the spectral absorption characteristics of the yellow, magenta and cyan dyes formed in the photosensitive printing material. Thus, spectral absorption characteristics are particularly important factors affecting color reproduction.

For instance, U.S. Pat. No. 4,960,685 discloses a method of improving color reproduction by using a specific combination of yellow, magenta and cyan couplers. Although such a method provides a marked improvement in color reproduction, it cannot satisfactorily maintain the quality of the magenta color image formed therein.

SUMMARY OF THE INVENTION

Therefore, an object of this invention is to provide a silver halide color photographic material which improves the keeping quality of a magenta color image as well as color reproduction.

As a result of various investigations into solving the above-described problem, it has now been found that the problem can be solved by the following color photographic material.

That is, this invention comprises a silver halide color photographic material having on a support at least one cyan dye-forming coupler-containing silver halide emulsion layer, at least one magenta dye-forming coupler-containing silver halide emulsion layer and at least one yellow dye-forming coupler-containing silver halide emulsion layer, wherein the cyan dye-forming coupler is a 1-naphthol type coupler having a naphthol nucleus in which a group represented by the following formula (I) binds directly to the 2-position of the naphthol nucleus, and the magenta dye-forming coupler is a 1H-pyrazolo[1,5-b]-1,2,4-triazole type coupler:

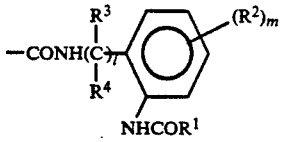

(I)

wherein $R^1$ represents a hydrogen atom, an alkyl group, an alkenyl group, an alkynyl group, a cycloalkyl group, an aralkyl group, or an aryl group; $R^2$ represents a substituent group; $R^3$ and $R^4$ each represents a hydrogen atom, an alkyl group, an aryl group, a halogen atom, an alkoxy group, or an aryloxy group; represents an integer from 0 to 4; and m represents an integer from 0 to 4.

In a further embodiment, this invention comprises the silver halide color photographic material described above, wherein each of the three kinds of silver halide emulsion layers comprises silver halide grains having a silver chloride content of 90 mol% or more.

DETAILED DESCRIPTION OF THE INVENTION

Cyan couplers which can be used in this invention are described in detail below.

The cyan couplers usable in this invention, which are characterized by a substituent group located at the 2-position of the 1-naphthol nucleus, are preferably represented by the following formula (Ia), (Ib) or (Ic):

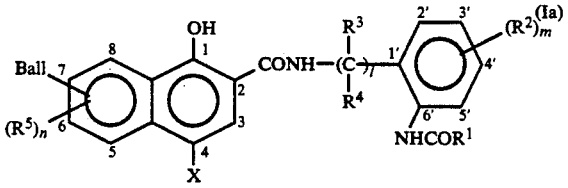

(Ia)

wherein $R^1$ represents a hydrogen atom, an alkyl group, an alkenyl group, an alkynyl group, a cycloalkyl group, an aralkyl group, or an aryl group; $R^2$ represents a substituent group; $R^3$ and $R^4$ each represents a hydrogen atom, an alkyl group, an aryl group, a halogen atom, an alkoxy group, or an aryloxy group; $R^5$ represents a substituent group; Ball represents a ballast group; X represents a hydrogen atom, or a coupling-off group; l represents an integer from 0 to 4; m represents an integer from 0 to 4; and n represents an integer from 0 to 4. The groups represented by $R^1$ to $R^4$ may have a substituent group.

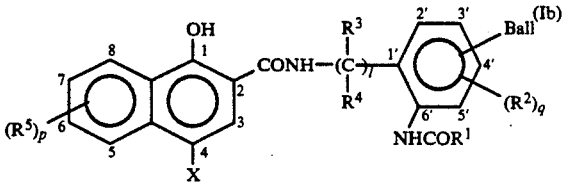

(Ib)

wherein $R^1$, $R^2$, $R^3$, $R^4$, $R^5$, Ball, l and X have the same meaning as in formula (Ia), respectively; q represents an integer from 0 to 3; and p represents an integer from 0 to 5.

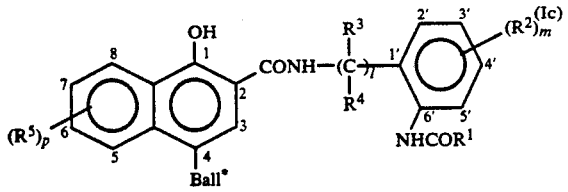

wherein $R^1$, $R^2$, $R^3$, $R^4$, $R^5$, m and p have the same meaning as in formula (Ia) or (Ib), respectively; Ball* represents a coupling-off group which can also function as a ballast group.

In formulae (Ia), (Ib) and (Ic), $R^1$ is preferably a hydrogen atom, a 1-8 carbon (more preferably a 1-3 carbon) alkyl group (e.g., methyl, ethyl, isopropyl, isobutyl, isoamyl, chloromethyl, fluoromethyl, difluoromethylmethoxymethyl, n-butyl), a 2-8 carbon (preferably a 2-4 carbon) alkenyl group (e.g., vinyl, propenyl, allyl), a 2-8 carbon (preferably a 2-4 carbon) alkynyl group (e.g., ethinyl, propargyl), a 3-8 carbon (preferably a 3-5 carbon) cycloalkyl group (e.g., cyclopropyl, 2-methylcyclopropyl, 1-methylcyclopropyl, 1-fluorocyclopropyl, cyclobutyl), a 7-12 carbon (preferably a 7-10 carbon) aralkyl group (e.g., benzyl, phenetyl), a 1-8 carbon (preferably a 1-4 carbon) alkoxy group (e.g., methoxy, ethoxy), or a 0-8 carbon (preferably a 0-4 carbon) amino group (e.g., amino, methylamino, ethylamino, dimethylamino, pyrrolidyl), or a 6-12 carbon (preferably a 6-10 carbon) aryl group (e.g., phenyl, p-tolyl, p-methoxyphenyl, o-tolyl), and particularly preferably an alkyl group or a cycloalkyl group.

In formulae (Ia), (Ib) and (Ic), $R^3$ and $R^4$ may be the same or different, and each represents a hydrogen atom, an alkyl group, an aryl group, a halogen atom, an alkoxy group or an aryloxy group. Each is preferably a hydrogen atom, a 1-24 carnbon (preferably a 1-16 carbon) alkyl group (e.g., methyl, ethyl, isopropyl, n-butyl, n-hexadecyl), a 6-24 carbon (preferably a 6-12 carbon) aryl group (e.g., phenyl), a halogen atom (e.g., F, Cl, Br, I), a 1-24 carbon (preferably a 1-12 carbon) alkoxy group (e.g., methoxy), or a 6-24 carbon (preferably a 6-12 carbon) aryloxy group (e.g., phenoxy), and particularly preferably a hydrogen atom or an alkyl group. When l is 2-4, plural

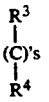

may be the same or different.

In formulae (Ia), (Ib) and (Ic), $R^2$ and $R^5$ each preferably represents a halogen atom (e.g., F, Cl, Br, I), a 1-12 carbon (preferably a 1-6 carbon) alkyl group (e.g., methyl, isopropyl, t-butyl), a 3-12 carbon (preferably a 3-6 carbon) cycloalkyl group (e.g., cyclopropyl, cyclohexyl), a 1-12 carbon (preferably a 1-6 carbon) alkoxy group (e.g., methoxy, n-butoxy), a 1-12 carbon (preferably a 1-6 carbon) alkylthio group (e.g., methylthio, n-dodecylthio), a 6-12 carbon (preferably a 6-10 carbon) aryloxy group (e.g., phenoxy, p-t-butyl-phenoxy), a 6-12 carbon (preferably a 6-10 carbon) arylthio group (e.g., phenylthio), a 1-12 carbon (preferably a 1-6 carbon) alkylsulfonyl group (e.g., methylsulfonyl), a 6-12 carbon (preferably a 6-10 carbon) arylsulfonyl group (e.g., p-tolylsulfonyl), a 1-12 carbon (preferably a 1-8 carbon) carbonamido group (e.g., acetamido, benzamido), a 1-12 carbon (preferably a 1-8 carbon) sulfonamido group (e.g., methanesulfonamido, p-toluenesulfonamido), a 1-12 carbon (preferably a 1-8 carbon) acyl group (e.g., acetoxy, benzoyloxy), a 1-12 carbon (preferably a 1-8 carbon) acyloxy group (e.g., acetoxy), a 2-12 carbon (preferably a 2-10 carbon) alkoxycarbonyl group (e.g., ethoxycarbonyl), a 1-12 carbon (preferably a 1-7 carbon) carbamoyl group (e.g., N-methylcarbamoyl), a 0-12 carbon (preferably a 0-8 carbon) sulfamoyl group (e.g., N-ethylsulfamoyl), a 1-12 carbon (preferably a 1-8 carbon) ureido group (e.g., 3-methylureido, 3- phenylureido), a 2-12 carbon (preferably a 2-10 carbon) alkoxycarbonylamino group (e.g., ethoxycarbonylamino), a cyano group or a nitro group, and particularly preferably a halogen atom, an alkyl group, an alkoxy group, an acyl group, a carbonamido group, a sulfonamido group, a carbamoyl group, a sulfamoyl group or a cyano group. When m or q is more than 1, plural $R^2$'s may be the same or different. Also, plural $R^5$'s may be the same or different when n or p is plural. The benzene ring in each of the formulae (Ia) and (Ib) may be substituted by one or more $R^2$ at any of the 2',3',4' and 5' positions, preferably at the 3'-, 4'- or 5'-position. The 1-naphthol nucleus in each of the general formulae (Ia) and (Ib) may be substituted by one or more $R^5$ at any of the 3, 5, 6, 7 and 8 positions, preferably at the 5-, 6- or 7-position.

Ball in each of formulae (Ia) and (Ib) represents a group having a size and a shape sufficient to impart nondiffusibility to the coupler represented by formula (Ia) or (Ib), and preferably includes a 6-36 carbon (more preferably a 8-24 carbon) alkyl, aryl, alkoxy, aryloxy, alkylthio, arylthio, alkylsulfonyl, arylsulfonyl, carbonamido, sulfonamido, carbamoyl, sulfamoyl, ureido, alkoxycarbonylamino, acyl, acyloxy, alkylsulfonyloxy and alkoxycarbonyl groups. Among these groups, alkyl, alkoxy, aryloxy, alkylthio, carbonamido, sulfonamido, carbamoyl, sulfamoyl, ureido and alkoxycarbonyl groups are preferred in particular. Ball may be situated at any of the 3-, 5-, 6-, 7- and 8-positions, preferably at the 5-, 6- or 7-position in formula (Ia), and at any of the 2'-, 3'-, 4'- and 5'-positions, preferably at the 3'-, 4'- or 5'-position, in formula (Ib).

X in each of formulae (Ia) and (Ib) represents a hydrogen atom, or a coupling-off group, that is, a group capable of being eliminated by a coupling reaction with an oxidation product of an aromatic primary amine developing agent, and preferably includes a hydrogen atom, a halogen atom (e.g., F, Cl, Br, I), a sulfo group, a thiocyanato group, a 1-16 carbon (preferably a 1-8 carbon) alkoxy group, a 6-16 carbon (preferably a 6-10 carbon) aryloxy group, a 1-16 carbon (preferably a 1-8 carbon) alkylthio group, a 6-36 carbon (preferably a 6-24 carbon) arylthio group, a 2-16 carbon (preferably a 2-12 carbon) heterocyclic oxy group, a 2-36 carbon (preferably a 2-24 carbon) heterocyclic thio group, a 1-24 carbon (preferably a 1-12 carbon) acyloxy group, a 1-24 carbon (preferably a 1-12 carbon) sulfonyloxy group, a 2-24 carbon (preferably a 2-12 carbon) carbamoyloxy group, a 1-36 carbon (preferably a 1-24 carbon) azolyl group, a 4-36 carbon (preferably a 4-24 carbon) imido group, and a 3-36 carbon preferably a 3-16 carbon) hydantoinyl group.

Among these atoms and groups, those having relatively great attraction to electrons, such as a halogen atom, a sulfo group, a thiocyanato group, a heterocyclic thio group, an azolyl group, an imido group, etc. are particularly preferred as X because they cause much less stain on the white background when exposed to light or heat.

In each of formulae (Ia), (Ib) and (Ic), l is preferably 1 or 2, and particularly preferably 1. m, n, q and p each is preferably 0 or 1, and particularly preferably 0.

Ball* in formula (Ic) has a size and a shape sufficient to impart nondiffusibility to the coupler represented by formula (Ic), and can be eliminated by a coupling reaction with an oxidation product of an aromatic primary amine developing agent, with suitable examples including 6–36 carbon (preferably a 8–24 carbon) alkoxy, aryloxy, alkylthio, arylthio, heterocyclyloxy, heterocyclylthio, acyloxy, sulfonyloxy, carbamoyloxy, azolyl and imido groups.

The cyan coupler represented by formula (Ic) may be dimerized or polymerized by combining one molecule of the cyan coupler with another via Ball*, or may assume a polymeric form by hanging like a pendant from a polymer chain (e.g., an ethylenic polymer chain, a polyester type condensed polymer chain) via Ball*. In this case, the above-described limitation placed on the number of carbon atoms contained in Ball* can be lifted. As for the form in which the naphthol type coupler of this invention binds to a polymer chain, the kind of copolymerizing monomers, or the method of polymerization, those disclosed, e.g., in U.S. Pat. No. 4,690,889 (columns 5 to 6), JP-A-62-276548 (pages 3 to 17), JP-A-01-224756 (pages 15–42), and EP-A-0357069 (pages 3–10) can be applied thereto. (The term "JP-A" as used herein means an "unexamined published Japanese patent application".)

The cyan couplers represented by formulae (Ia) and (Ib) are preferred to those represented by formulae (Ic) because the cyan dye images formed by the former undergo only slight changes in hue with the lapse of time, compared with those formed by the latter.

Specific examples of substituent groups in formulae (Ia) and (Ib) are shown below.

Examples of $-NHCOR^1$:

$-NHCOH$, $-NHCOCH_3$, $-NHCOC_2H_5$, $-NHCOC_3H_{7}$-i, $-NHCOCH_2Cl$, $-NHCOCH_2F$,

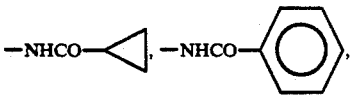

$-NHCOOCH_3$, $-NHCONHCH_3$.

Examples of $-\overset{R^3}{\underset{R^4}{C}}-$:

$-CH_2-$, $-(CH_2)_2-$, $-(CH_2)_3-$, $-(CH_2)_4-$,

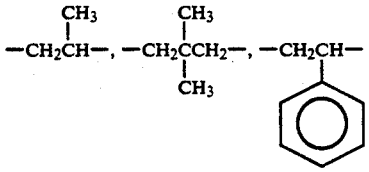

Examples of $R^2$ and $R^5$:

-continued

F, Cl, Br, I, $-CH_3$, $-OCH_3$, $-NHCOCH_3$, $-NHSO_2CH_3$, $-SCH_3$, $-SO_2CH_3$,

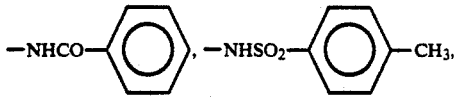

$-CONH_2$, $-SO_2NHC_2H_5$, $-NHCONHCH_3$, $-CF_3$, $-CN$, $-COCH_3$.

Examples of Ball:

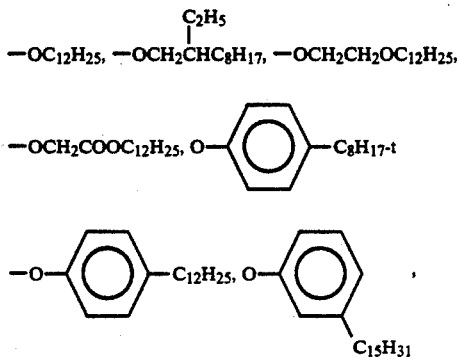

$-SC_{12}H_{25}$, $-SO_2C_{16}H_{33}$, $-COOC_{12}H_{25}$, $-SCH_2CH_2COOC_{12}H_{25}$, $-C_{12}H_{25}$, $-C_{15}H_{31}$-t, $-NHCOC_{15}H_{31}$, $-NHSO_2C_{12}H_{25}$, $-CONHC_{12}H_{25}$, $-SO_2NHC_{16}H_{33}$, $-NHCONHC_{12}H_{25}$,

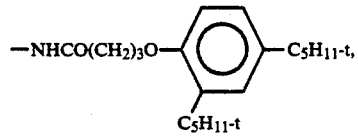

$-OCOC_{15}H_{31}$, $-OSO_2C_{12}H_{25}$,

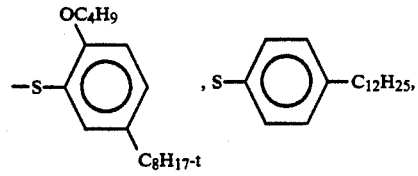

$-OC_{16}H_{33}$.

Examples of X:

H, F, Cl, Br, I, $-SO_3H$, $-SCN$, $-OCH_2COOH$, $-OCH_2COOCH_3$, $-OCH(CH_3)COOC_2H_5$, $-OCH_2CH_2Cl$, $-OCH_2CH_2SCH_2COOH$,

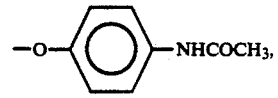

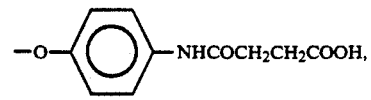

-continued $-SCH_2COOH$, $-SCH_2CH_2COOH$, $-SCH_2CH_2OH$,

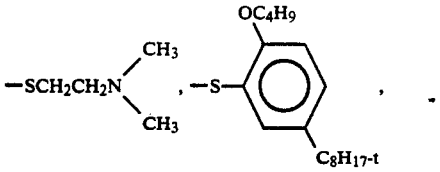

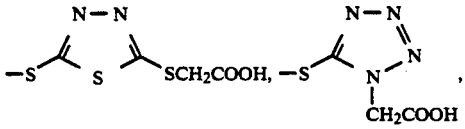

$-OCOCH_3$, $-OCO-$ 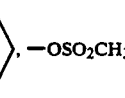 , $-OSO_2CH_3$, $-OCOOC_2H_5$, $-OCONHC_2H_5$, $-SO_2CH_3$,

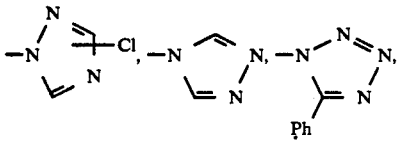

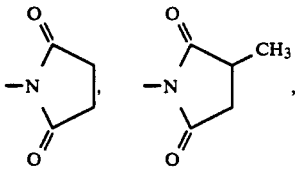

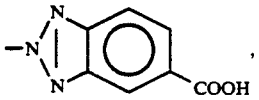

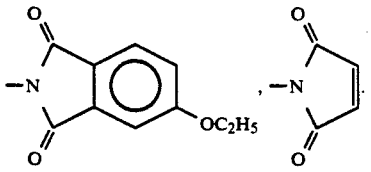

Examples of Ball*:

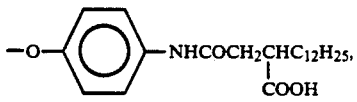

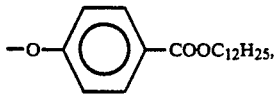

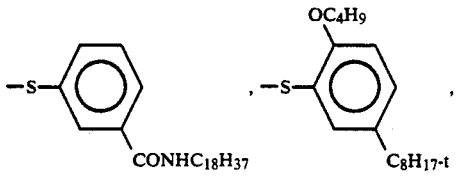

-continued $-SCHC_{12}H_{25}$ (COOH), $-SCH_2COOC_{12}H_{25}$, $-OCOC_{15}H_{31}$, $-OSO_2C_{16}H_{33}$, $-OCONHC_{12}H_{25}$, $-OP(=O)(OC_8H_{17})_2$, $-OCOOC_{12}H_{25}$, $-OCHC_{12}H_{25}$ ($COOC_2H_5$), $-OCHC_{12}H_{25}$ (COOH),

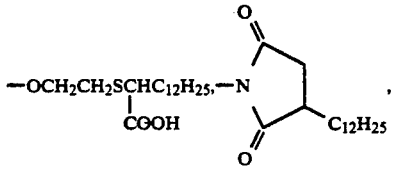

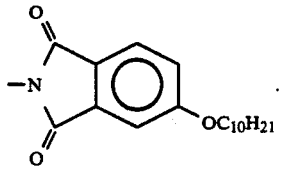

Specific examples of cyan couplers preferably used in this invention are illustrated below. However, the invention should not be construed as being limited to these compounds.

(1)

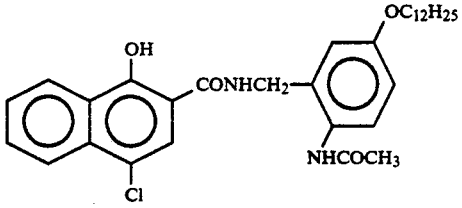

(2)

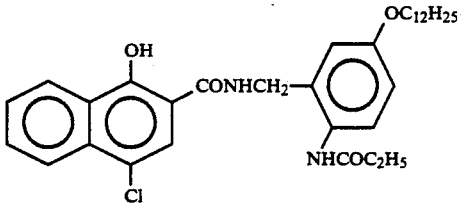

(3)

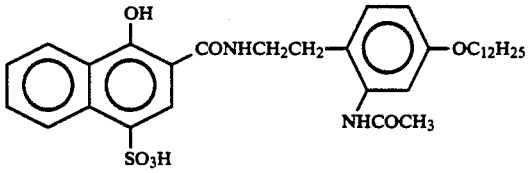

(4)

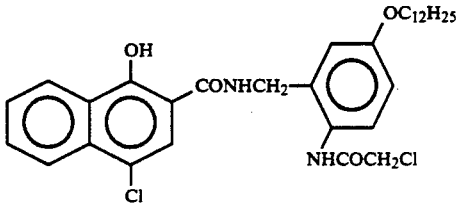

-continued
(5)
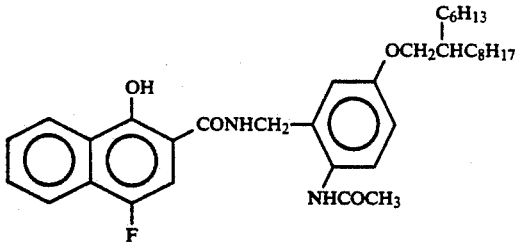
(6)
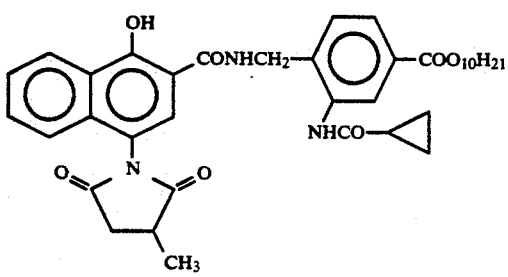
(7)
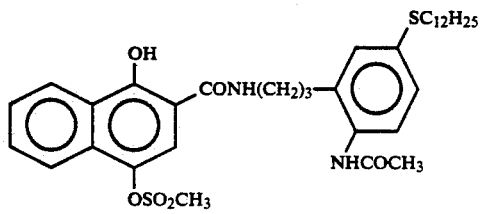
(8)
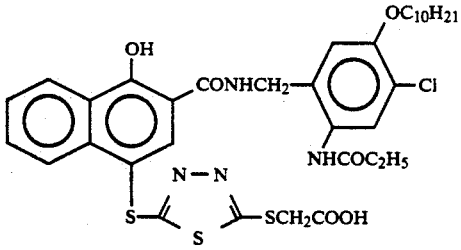
(9)
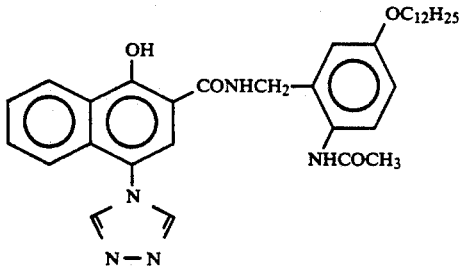
(10)
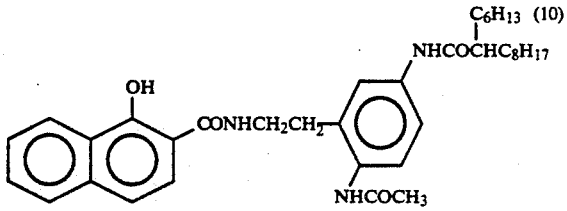
(11)
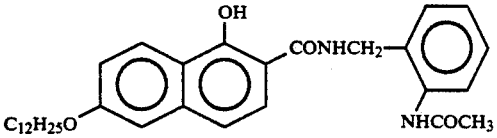
-continued
(12)
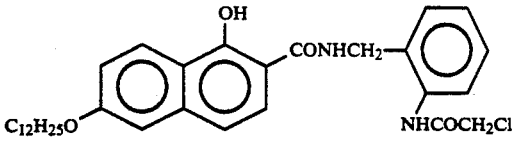
(13)
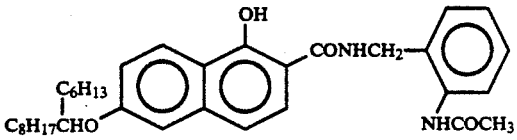
(14)
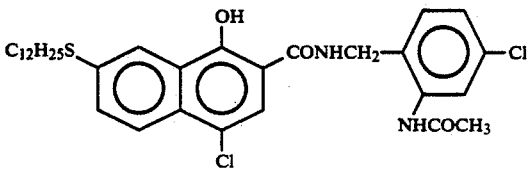
(15)
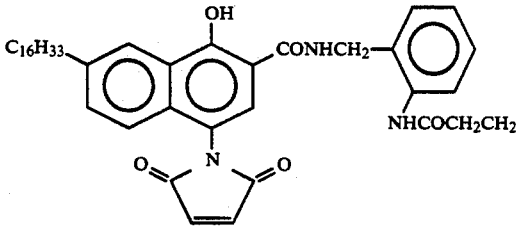
(16)
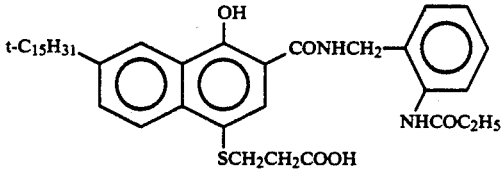
(17)
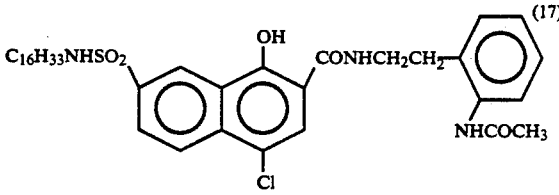
(18)
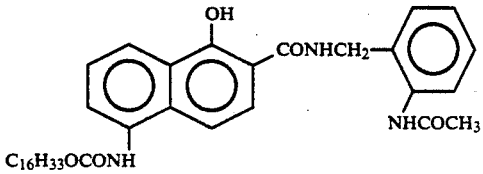

-continued
(19)
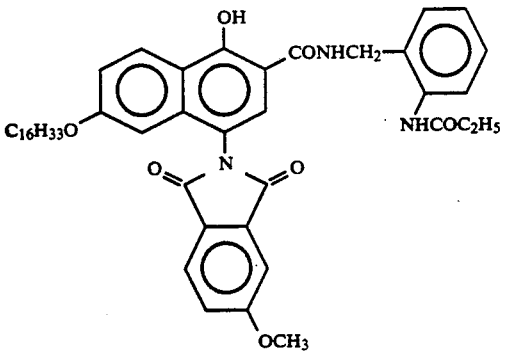
(20)
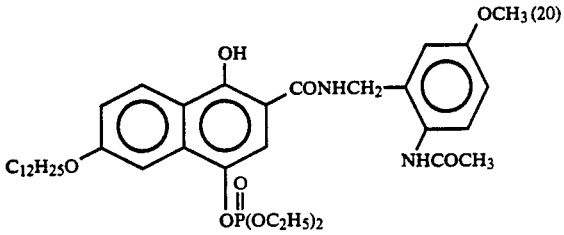
(21)
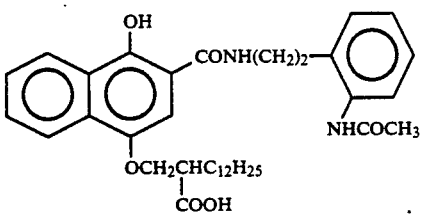
(22)
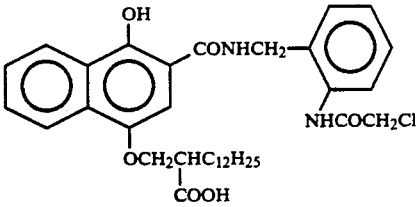
(23)
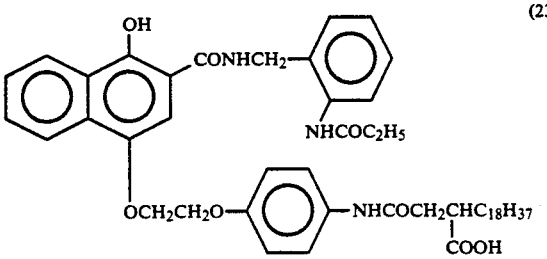
-continued
(24)
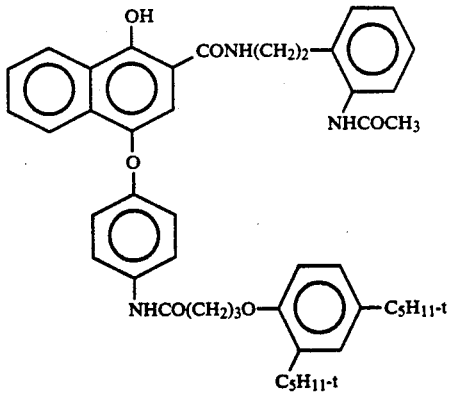
(25)
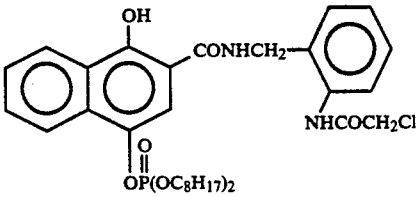
(26)
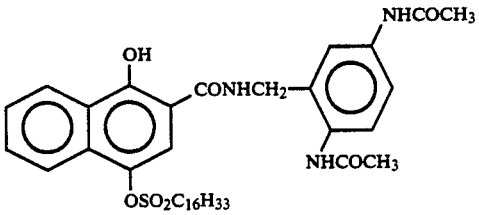
(27)
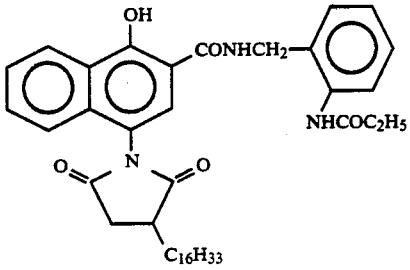
(28)
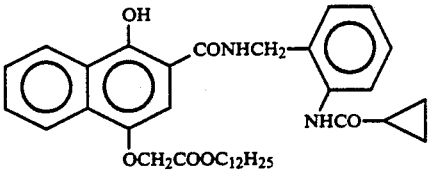
(29)
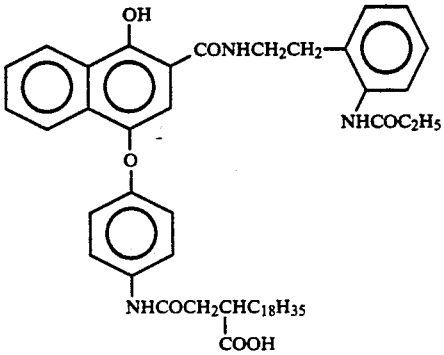

-continued (30)

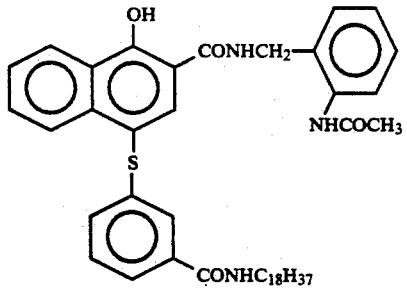

(31)

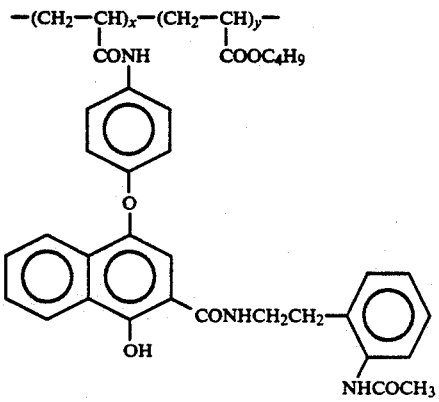

x:y = 50:50 (by weight)

(32)

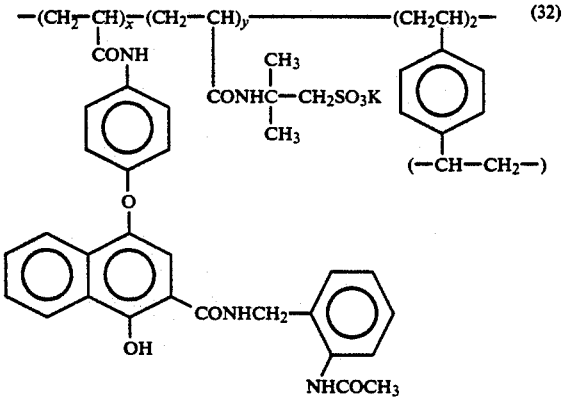

x:y:z = 55:45:10 (by weight)

(33)

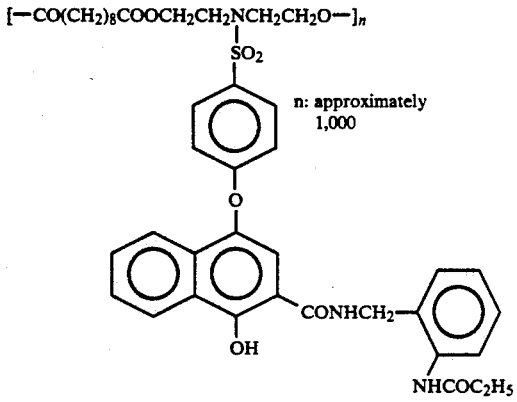

-continued (34)

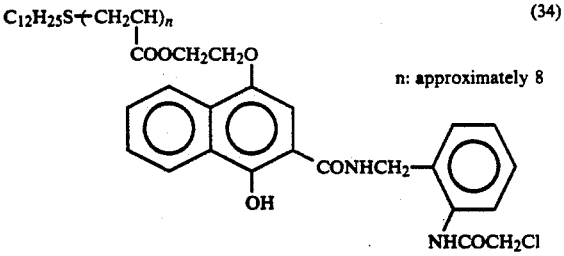

The cyan couplers of this invention can be synthesized using the process disclosed in JP-A-55-108662 and other known ones. Specific examples of syntheses thereof are illustrated below.

SYNTHESIS EXAMPLE 1

Synthesis of Coupler (1)

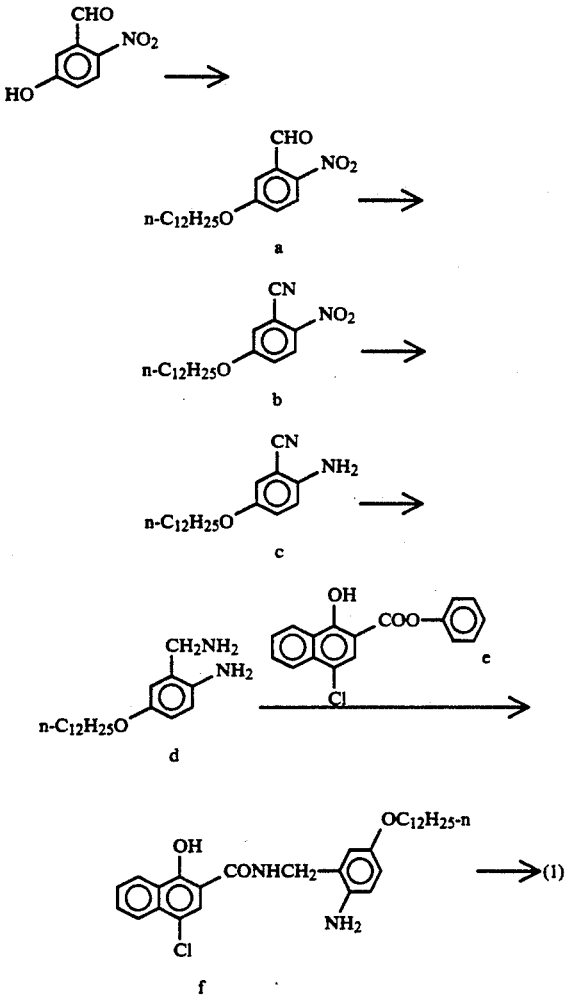

15.0 g of 5-hydroxy-2-nitrobenzaldehyde were dissolved in 100 ml of N,N-dimethylformamide, and added thereto were 21.2 g of sodium carbonate. The resulting mixture was stirred at 80° C., and 22.5 g of dodecyl bromide was added dropwise thereto over a 30-minute period. The stirring was continued for an additional one hour. After cooling, the reaction product was admixed with water, extracted with ethyl acetate, washed with water three times, concentrated, and then recrystallized from acetonitrile to provide 14.9 g of Compound a.

14.9 g of Compound a and 3.96 g of hydroxylamine hydrochloride were dissolved in 100 ml of formic acid, and refluxed for 4 hours. After cooling, water was added thereto to deposit crystals. The crystals were filtered off, washed with water three times, and recrystallized from acetonitrile to provide 11.2 g of Compound b.

14.0 g of iron, 30 ml of water and 1 ml of acetic acid were stirred for 10 minutes under reflux, and then 200 ml of 2-propanol were added thereto, and further refluxed. 11.2 g of Compound b were added slowly, and stirring was continued for an additional 30 minutes. Thereafter, the obtained reaction mixture was filtered through Cerite while it was hot, and washed with ethyl acetate. The filtrate was concentrated, and recrystallized from 2-propanol to provide 7.7 g of Compound c.

7.7 g of Compound c were dissolved in a mixture of 50 ml of 2-propanol and 30 ml of aqueous ammonia, and added thereto was 1 g of Raney nickel as a catalyst. The resulting mixture was placed in an autoclave, and underwent a reaction for 8 hours at 80° C. 30-atm. Then, the Raney nickel was removed by filtration through Cerite, and the residue was washed with ethyl acetate. The thus obtained filtrate was concentrated, and recrystallized from acetonitrile to provide 7.5 g of Compound d.

7.5 g of Compound d and 6.0 g of Compound e were dissolved together in 100 ml of acetonitrile, and refluxed for 6 hours. After cooling, the deposited crystals were filtered off, washed successively with water and acetonitrile, and recrystallized from acetonitrile to provide 10.3 g of Compound f.

2.56 g of Compound f and 0.5 g of pyridine were dissolved in 50 ml of N,N-dimethylacetamido, and stirred at room temperature, and added dropwise thereto were 0.47 g of acetyl chloride over a 10-minute period. Stirring was continued for an additional 30 minutes. Then, the reaction mixture was admixed with water and the product was extracted with ethyl acetate, washed with water three times, concentrated, and recrystallized from acetonitrile. Thus, 2.21 g of coupler (1) were obtained. The melting point thereof was 104°-115° C. The structure thereof was confirmed by $^1$H-NMR spectral, mass spectral and elemental analyses.

SYNTHESIS EXAMPLE 2

Synthesis of Coupler (4)

The synthesis was carried out in accordance with the same reaction scheme as in Synthesis Example 1, except 0.68 g of chloroacetyl chloride were used in place of acetyl chloride, to obtain 2.11 g of coupler (4) The melting point of this compound was 128°-129° C., and the structure thereof was confirmed by $^1$H-NMR spectral, mass spectral and elemental analyses.

SYNTHESIS EXAMPLE 3

Synthesis of Coupler (11)

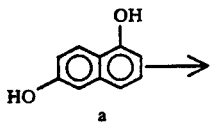

-continued

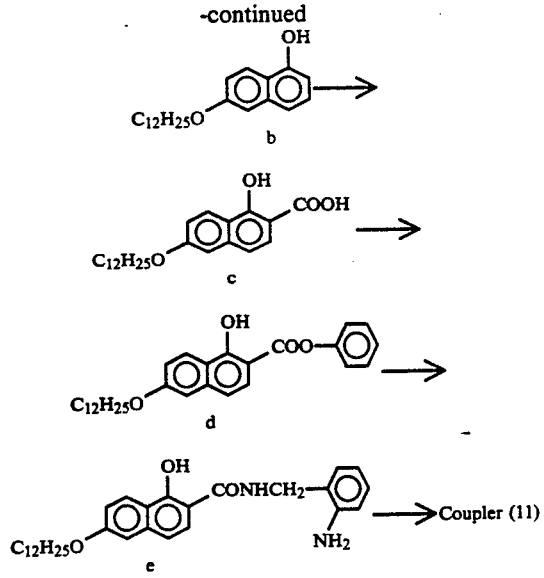

13 g of 60% sodium hydride were added dropwise to 51 g of 1,6-dihydroxynaphthalene (Compound a) dissolved in 450 ml of dimethylformamide (DMF) with stirring at room temperature in a stream of nitrogen gas. Then, the reaction system was heated to 50° C. with stirring, and added dropwise thereto were 39.4 g of lauryl bromide. Further, the stirring was continued for an additional 2 hours. After cooling, the reaction mixture was added to 2 l of dilute hydrochloric acid, and extracted with 1 l of ethyl acetate. The ethyl acetate solution was desiccated, concentrated, and then isolated and purified by column chromatography using silica gel as a packing agent and an ethyl acetate/n-hexane mixture as a developer to yield 34 g of Compound b in an oily condition (which was crystallized upon standing).

34 g of Compound b were dissolved in 200 ml of DMF, and added thereto were 4.5 g of 60% sodium hydride in a stream of nitrogen gas. Then, carbon dioxide gas was bubbled for 3 hours into the reaction system, which was heated up to 150° C. with stirring. After cooling, the reaction mixture was added to 1 of dilute hydrochloric acid, and extracted with 500 ml of ethyl acetate. The obtained ethyl acetate solution was desiccated, concentrated, and crystallized from acetonitrile to yield 31 g of crystalline Compound c.

30.6 g of Compound c, 9.3 g of phenol and 5 ml of DMF were dissolved in 300 ml of acetonitrile, and added dropwise thereto were 6.4 ml of thionyl chloride as the reaction mixture was heated under reflux. After two hours of heating under reflux, the reaction mixture was cooled to precipitate crystals. The crystals were filtered off to yield 24 g of crystalline Compound d.

100 ml of acetonitrile were added to the mixture of 6.3 g of Compound d and 2.6 g of o-aminobenzylamine, and heated for 5 hours under reflux. The obtained reaction mixture was cooled to precipitate crystals. The crystals were filtered off to obtain 6.2 g of crystalline Compound e.

0.8 g of acetic anhydride were added dropwise to 3.3 g of Compound dissolved in 30 mol of DMF with stirring at room temperature. After 5 hours of stirring, the reaction mixture was allowed to stand for one night. The resulting solution was admixed with 200 ml of water, and extracted with 50 ml of ethyl acetate. The ethyl acetate solution was desiccated, and concentrated. The residue was admixed with acetonitrile to be dissolved therein, and then crystals were precipitated. Thus, 3.1 g of Coupler (11) were obtained.

The melting point of this coupler was 127°-129° C., and the structure thereof was confirmed by $^1$H-NMR spectral, ass spectral and elemental analyses.

SYNTHESIS EXAMPLE 4

Synthesis of Coupler (18)

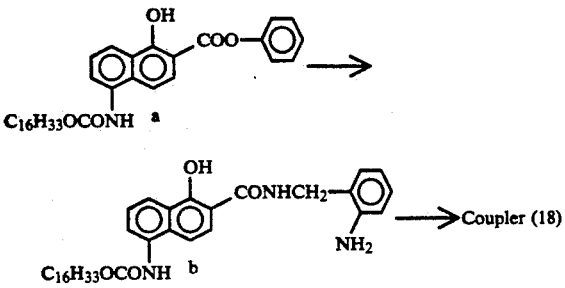

100 ml of acetonitrile were added to the mixture of 5.5 g of Compound a prepared in accordance with the synthesis method disclosed in U.S. Pat. No. 4,690,889 with 1.5 g of o-aminobenzyl, and heated for 3 hours with stirring. After cooling to room temperature by standing, the crystals were separated out and filtered off to obtain 5.6 g of Compound b.

5.6 g of Compound b were dissolved in 50 ml of dimethylacetamide (DMAc), and added dropwise thereto were 1.5 g of acetic anhydride. After stirring was continued for 5 hours, the reaction solution was admixed with 300 ml of water, and extracted with 100 ml of ethyl acetate. The ethyl acetate solution was desiccated, and concentrated. To the residue, acetonitrile was added to precipitate the crystals. Thus, 5.4 g Coupler (18) were obtained.

The melting point of this coupler was 174°-178° C., and the structure thereof was confirmed by $^1$H-NMR spectral, mass spectral and elemental analyses.

SYNTHESIS EXAMPLE 5

Synthesis of Coupler (22)

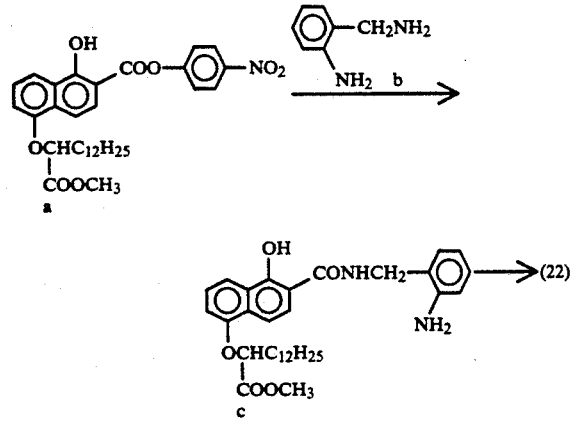

17.0 g of Compound a and 5.5 g of Compound b were dissolved in 200 ml of acetonitrile, and stirred for 5 hours under reflux. After concentration, the reaction mixture was dissolved in ethyl acetate, washed with water, and concentrated. The residue was recrystallized from acetonitride to yield 9.1 g of Compound c.

3.38 g of Compound c and 0.6 g of pyridine were dissolved in 50 ml of N,N-dimethylacetamide, and stirred at room temperature. 0.81 g of chloroacetyl chloride were added dropwise over a period of about 30 minutes. The reaction system was further stirred for 30 minutes. Water was added thereto to precipitate crystals. The obtained crystals was filtered off, washed with water, and recrystallized from acetonitrile to give 3.33 g Coupler (22). The melting point of this coupler was 144°-145° C., and the structure thereof was confirmed by $^1$H-NMR spectral, mass spectral and elemental analyses.

Next, the 1H-pyrazolo[1,5-b]-1,2,4-triazole type magenta dye-forming couplers used in this invention are illustrated below.

1H-pyrazolo[1,5-b]-1,2,4-triazole type magenta dye-forming couplers are represented by the following formula (II):

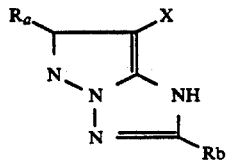

(II)

In the above formula (II), Ra and Rb may be the same or different, and each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group. Among these groups, particularly preferred are an alkyl group, an alkoxy group, an alkylthio group, an aryl group, an aryloxy group, an arylthio group, an acylamino group and an anilino group.

X represents a hydrogen atom, a halogen atom, a carboxyl group, or group which is attached to the carbon atom located at the coupling site via an oxygen, nitrogen or sulfur atom, and eliminated by the coupling reaction.

The magenta couplers of formula (II) may form a bis compound via Ra, Rb or X.

Also, the magenta couplers represented by formula (II) may assume a polymeric form such that moieties represented by formula (II) are present in the main chain or side chains of the polymer. In particular, polymers derived from vinyl monomers containing the coupler moiety represented by formula (II), wherein Ra, Rb or X represents a vinyl group or a linking group, are preferred.

Specific examples of a linking group represented by Ra, Rb or X when the coupler moiety represented by formula (II) is contained in a vinyl monomer include substituted and unsubstituted alkylene groups (e.g., methylene, ethylene, 1,10-decylene, —$CH_2$C-

$H_2OCH_2CH_2$—), substituted or unsubstituted phenylene groups (e.g., 1,4-phenylene, 1,3-phenylene,

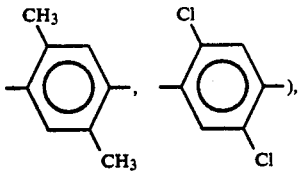

—NHCO—, —CONH—, —O—, —OCO—, aralkylene groups (e.g.,

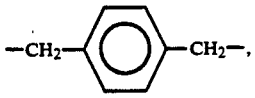

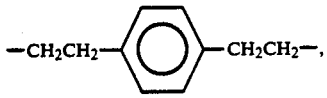

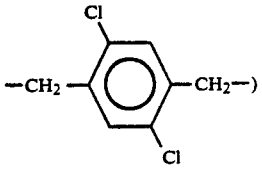

and groups formed by combining the above-cited groups.

Suitable examples include —NHCO—, —$CH_2CH_2$—,

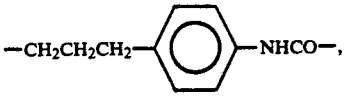

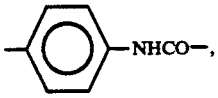

—$CH_2CH_2$—NHCO—, —$CH_2CH_2$—OCO—, —CONH—$CH_2CH_2$—NHCO—, —$CH_2CH_2O$—$CH_2CH_2$—NHCO—, and

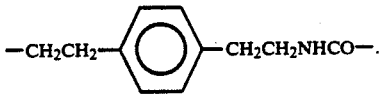

The couplers represented by formula (II) can be used in an emulsion layer in amount of generally from $1\times10^{-2}$ to 1 mole, preferably $1\times10^{-1}$ to 5x10-1 mole, per mole of silver halide present in the emulsion layer. The magenta couplers of this invention can be used together with other types of magenta couplers, if desired.

Typical examples of the magenta couplers represented by formula (II) are illustrated below.

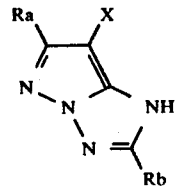
| Compound | Ra | Rb | X |
|---|---|---|---|
| II-1 | $CH_3$— | 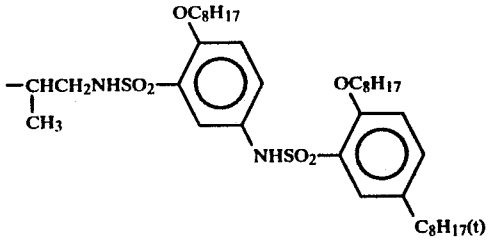 | Cl |
| II-2 | $CH_3$— | 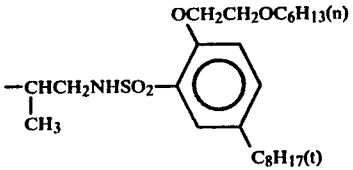 | Cl |
| II-3 | $(CH_3)_3C$— | 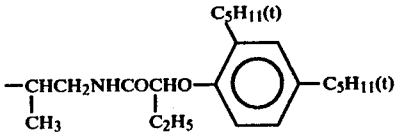 | 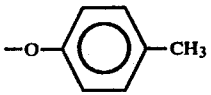 |
| II-4 | 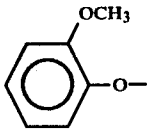 | 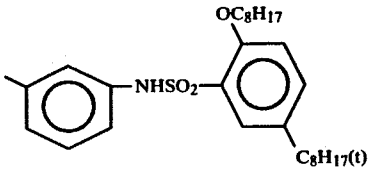 | 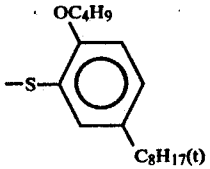 |

-continued
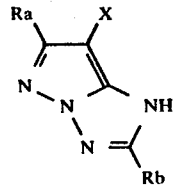
| Compound | Ra | Rb | X |
|---|---|---|---|
| II-5 | $CH_3$— | 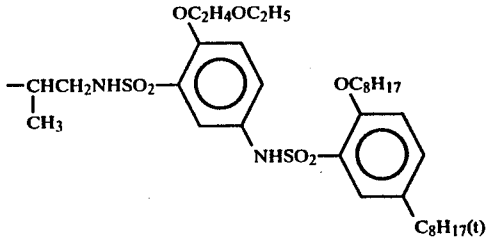 | Cl |
| II-6 | $CH_3$— | 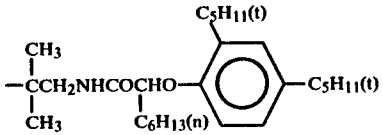 | Cl |
| II-7 | $CH_3$— | 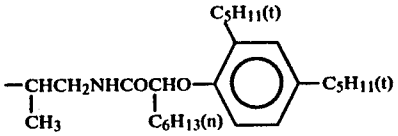 | Cl |
| II-8 | $CH_3$— | 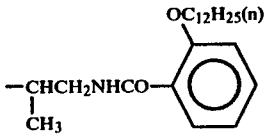 | Cl |
| II-9 | $CH_3$— | 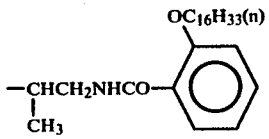 | Cl |

-continued
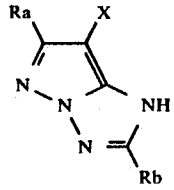
| Compound | Ra | Rb | X |
|---|---|---|---|
| II-10 | 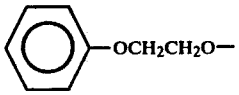 | 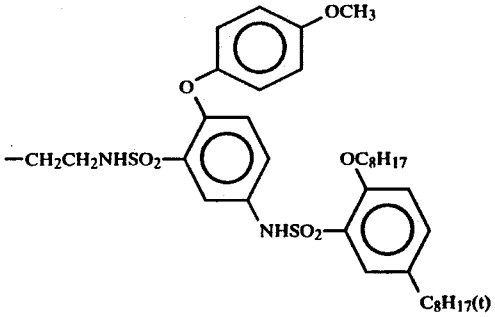 | 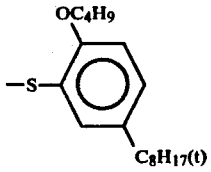 |
| II-11 | $CH_3CH_2O-$ | " | " |
| II-12 | 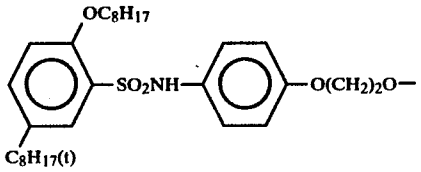 | 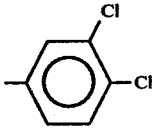 | " |
| II-13 | 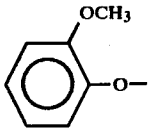 | 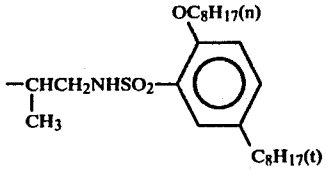 | Cl |

-continued
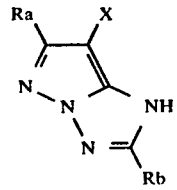
| Compound | Ra | Rb | X |
|---|---|---|---|
| II-14 | $CH_3$— | 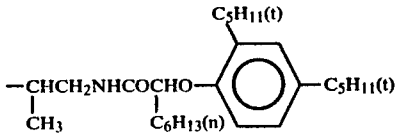 | Cl |
| II-15 | $CH_3$— | 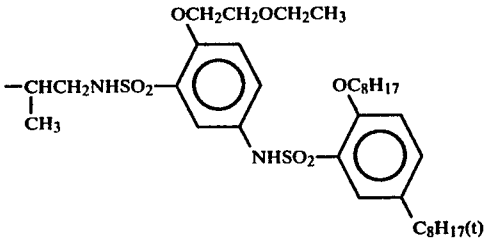 | Cl |
| II-16 | $CH_3CH_2O$— | 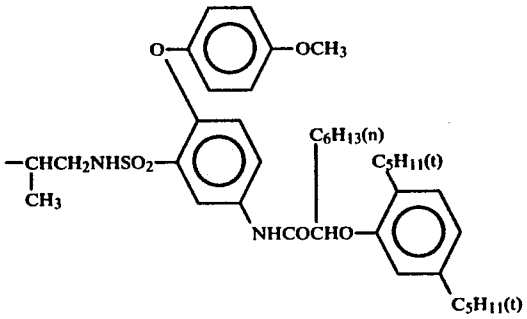 | 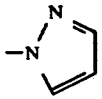 |

-continued
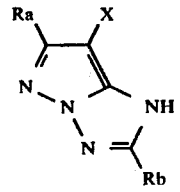
| Compound | Ra | Rb | X |
|---|---|---|---|
| II-17 | 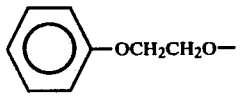 | 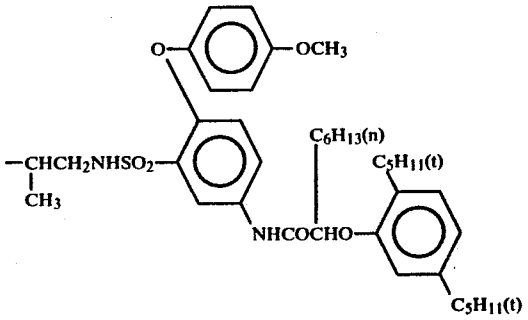 | 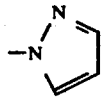 |
| II-18 | " | 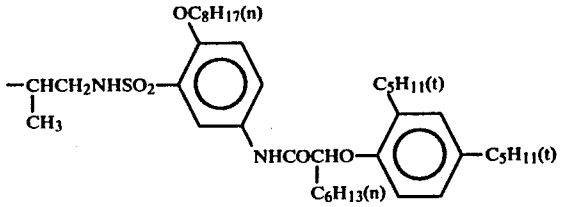 | " |
| II-19 | 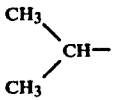 | 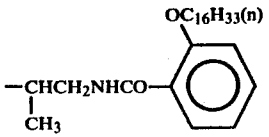 | 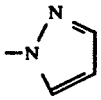 |

-continued
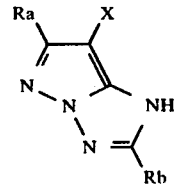
| Compound | Ra | Rb | X |
|---|---|---|---|
| II-20 | 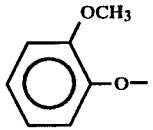 | 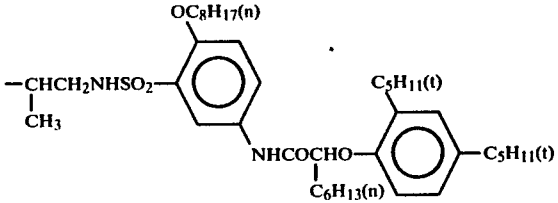 | Cl |
| II-21 | 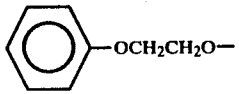 | 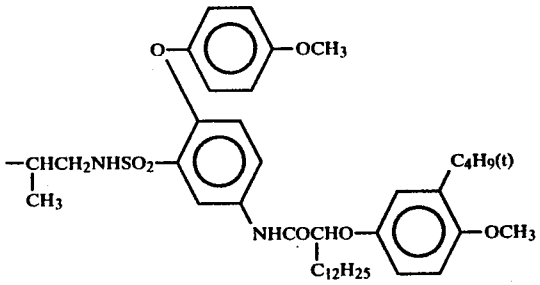 | 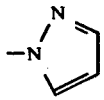 |
| II-22 | $CH_3$— | 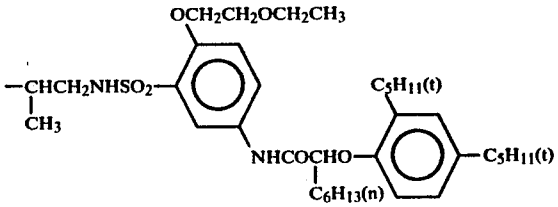 | Cl |

The color photographic light-sensitive material of this invention can comprise a support having thereon at least one blue-sensitive silver halide emulsion layer, at least one green-sensitive silver halide emulsion layer, and at least one red-sensitive silver halide emulsion layer. In a general color photographic paper, silver halide emulsion layers are usually coated on a support in the above-described order. However, coating orders different from the foregoing one may be adopted. Also, infrared-sensitive silver halide emulsion layers may be provided in place of at least one of the foregoing emulsion layers.

Color reproduction according to the subtractive color process can be effected by incorporating the combinations of silver halide emulsions having sensitivities in their respective wavelength regions with color couplers capable of forming dyes. Each coupler has a complementary color relationship to the light wavelength to which its corresponding emulsion is sensitized, that is to say, the relationship of a yellow dye to blue light, that of a magenta dye to green light, or that of a cyan dye to red light, in the foregoing light-sensitive silver halide emulsion layers, respectively. However, different correspondences of sensitizing light to hue of developed color may be adopted.

The silver halide which can be preferably used in the silver halide emulsions of this invention includes substantially iodide-free silver chlorobromide and silver chloride. The expression "substantially iodide-free" as used herein means that the iodide content therein is below 1 mol %, preferably below 0.2 mol %.

The halide composition of the silver halide may be different or the same among emulsion grains. However, it is easier to impart uniform properties to the grains by the use of emulsions having the same halide composition among the emulsion grains.

As for the halide distribution of the silver halide emulsion grains, grains of the type which are uniform throughout in halide composition, that is to say, assume a uniform structure; grains of the type which differ in halide composition between the inner part (core) and the core-surrounding part (shell constructed by one or more of a layer), that is to say, assume a layer structure; or grains of the type which contain parts differing in halide composition inside or at the surface thereof without taking a layer form (e.g., the different parts are present at edges, corners or faces in a fused condition when they are present at the grain surface) can be chosen properly depending on their use. For the purpose of achieving high sensitivity, it is more advantageous to use layered structure grains as in either of the latter two types rather than to use grains having a uniform structure. Further, the grains of the latter two types are favored with respect to pressure resistance. When the grains have a layer structure as described above, the boundary between the parts differing in halide composition may be a distinct boundary with a clear interface, or may be an indistinct boundary with the fomation of mixed crystals due to the difference in halide composition. Also, a continuous change in structure may be positively made in the boundary region.

In the silver chlorobromide emulsion grains having such a structure as described above, the ratio of silver bromide to silver chloride can be chosen arbitrarily. Though this ratio can be varied widely depending on the purpose, it is desirable that the emulsion preferably contains at least 2 mol % silver chloride.

On the one hand, a silver halide emulsion having a high chloride content, known as a high chloride emulsion, is advantageously used to produce a light-sensitive material suitable for rapid processing. A preferred chloride content in such a high chloride content emulsion is 90 mol % or more, particularly 95 mol % or more.

The foregoing high chloride emulsion preferably should have, as described above, a structure such that silver bromide-localized phases are present inside and/or at the surface of the grains with or without assuming a layer form. In the localized phases, the bromide content therein should be at least 10 mol %, preferably more than 20 mol %. Such localized phases can be present inside the grains, or at the edges, corners or faces of the grain surface. Preferably, the localized phases formed by epitaxial growth are present at the corners of each grain.

On the other hand, for the purpose of effectively inhibiting a drop in sensitivity from occurring when pressure is imposed on the sensitive material, it is also preferable to use grains whose halide composition has an almost uniform distribution throughout, that is to say, has a uniform structure, even in a high chloride emulsion having a chloride content of 90 mol % or more.

Also, it is effective to further increase chloride content in the silver halide emulsion for the purpose of reducing the amount of developing solution to be replenished. In this case, an almost pure silver chloride emulsion having a chloride content of from 98 to 100 mol % is advantageously used.

The average grain size of the silver halide grains contained in the silver halide emulsions used in this invention is preferably from 0.1 to 2 $\mu$. As used herein, "grain size" refers to the diameter of a circle having the same area as the projected area of the grain, and the average grain size is the number average of these values.

As for the grain size distribution among the grains, a so-called monodisperse emulsion which has a variation coefficient (the value obtained by dividing the standard deviation of grain size distribution by the average grain size) of 20% or less, desirably 15% or less, is preferred. For the purpose of obtaining a wide latitude, it is advantageous to coat a blend of monodisperse emulsions differing in average grain size in a single layer, or to coat them separately in a multiple layer.

The silver halide grains in the photographic emulsions may have a regular crystal form, such as a cube, a tetradecahedron or an octahedron; an irregular crystal form, such as a sphere, a plate (tabular) etc.; or a composite form thereof. Also, the grains may be a mixture of silver halide grains having various crystal forms. It is desirable in this invention that the proportion of the silver halide grains having a regular crystal form such as described above present in the photographic emulsion should be at least 50 mol %, preferably more than 70 mol %, and more preferably more than 90 mol %.

In addition, it is desirable in this invention to use an emulsion such that the proportion of tabular silver halide grains having an average aspect ratio (a ratio of a projected area diameter to a thickness) of 5 or more, preferably 8 or more, to all of the silver halide grains present in the emulsion may be more than 50%, based on the projected area.

The silver chlorobromide emulsion used in this invention can be prepared using various methods as described in, for example, P. Glafkides, *Chemie et Phisique Photographique*, Paul Montel, Paris (1967), G. F. Duffin, *Pho-*

*tographic Emulsion Chemistry,* The Focal Press, London (1966), V. L. Zelikman et al, *Making and Coating Photographic Emulsion,* The Focal Press, London (1964); etc. Specifically, any processes including an acid process, a neutral process and an ammonia process may be employed.

Suitable methods for reacting a water-soluble silver salt with a water-soluble halide include, e.g., a single jet method, a double jet method, or a combination thereof. Also, a method in which silver halide grains are produced in the presence of excess silver ion (the reverse mixing method) can be employed. On the other hand, the controlled double jet method, in which the pAg of the liquid phase in which silver halide grains are to be precipitated is maintained constant, may be also employed. According to this method, a silver halide emulsion having a regular crystal form and an almost uniform distribution of grain sizes can be obtained.

In the process of producing silver halide grains or allowing the produced silver halide grains to ripen physically, various kinds of polyvalent metal ion impurities can be introduced. Examples of compounds usable for the foregoing purpose include cadmium salts, zinc salts, lead salts, copper salts, thallium salts, and single or complex salts of Group VIII elements, such as iron, ruthenium, rhodium, palladium, osmium, iridium, platinum, etc. Of these, salts of Group VIII elements are preferred. Amounts of these compounds to be added, are preferably from $10^{-8}$ to $10^{-2}$ mole per mole of silver halide, although amounts can be varied over a wide range depending on the purpose.

The silver halide emulsions used in this invention are, in general, chemically and spectrally sensitized.

Chemical sensitization can be effected using a sulfur sensitization process comprising the addition of an unstable sulfur compound, a sensitization process utilizing a noble metal compound represented by a gold compound, a reduction sensitization process, or a combination thereof. Compounds which are preferably used in this invention for chemical sensitization include those disclosed in JP-A-62-215272, from the right lower column on page 18 to the right upper column on page 22.

Spectral sensitization is carried out for the purpose of imparting spectral sensitivity in a desired wavelength region to form each light-sensitive emulsion layer in the photographic material of this invention. Spectral sensitization can be effectively carried out in this invention by adding dyes capable of absorbing light in the wavelength regions corresponding to the desired spectral sensitivities (known as spectral sensitizing dyes). Spectral sensitizing dyes which can be used for the above-described purpose include those described, e.g, in F. M. Harmer, *Heterocyclic Compound—Cyanine Dyes and Related Compounds,* John Wiley & Sons, New York and London (1964). Specific examples of compounds and spectral sensitization processes which can be employed to advantage in this invention include those disclosed in the above-cited JP-A-62-215272, from the right upper column on page 22 to page 38.

The silver halide emulsions used in this invention can contain a wide variety of compounds or precursors thereof for the purpose of preventing fog or stabilizing photographic functions during production, storage, or photographic processing. Specific examples of such compounds which can be preferably used in this invention include those disclosed in the above-cited JP-A-62-215272, on pages from 39 to 72.

Examples of yellow couplers which can be used in the silver halide color photographic material of this invention include acylacetanilide type couplers. Of these, there are two groups, referred to as class (1) and class (2), that are most preferred for color reproduction.

Class (1) consists of acylacetanilide type couplers which have an alkoxy, alkyl, aryloxy or dialkylamino group at the o-position of the anilino group. Since these couplers produce yellow dyes showing their absorption maxima at shorter wavelengths than conventional couplers of the kind which have a chlorine atom at the o-position, undesired absorption in the green region is lessened which results in higher color purity.

Representatives of couplers of class (1) are illustrated below:

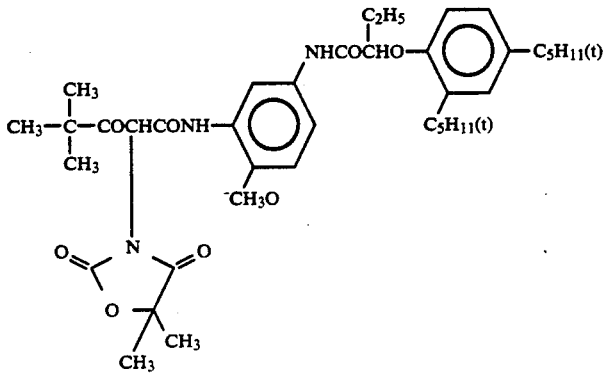

-continued

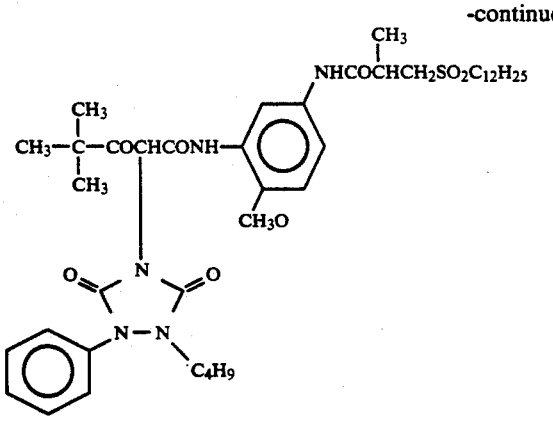

Class (2) consists of acylacetanilide type couplers which contain a 1-methylcylopropanecarbonyl group, a 1-methylcyclobutanecarbonyl group or a 1-methylcyclopentanecarbonyl group as their respective acyl groups. These couplers produce yellow dyes having such spectral absorption characteristics that they exhibit their absorption maxima at shorter wavelengths, and the shapes of their absorption curves are sharp on the longer wavelength side, so undesired absorption in the green region is lessened which results in high color purity.

Representatives of these couplers are illustrated below:

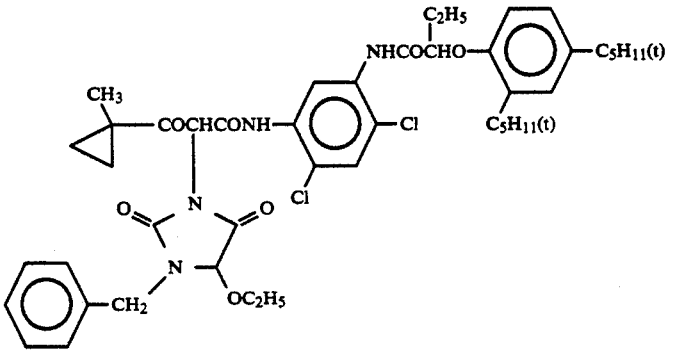

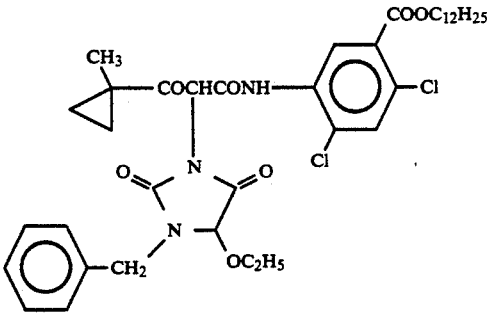

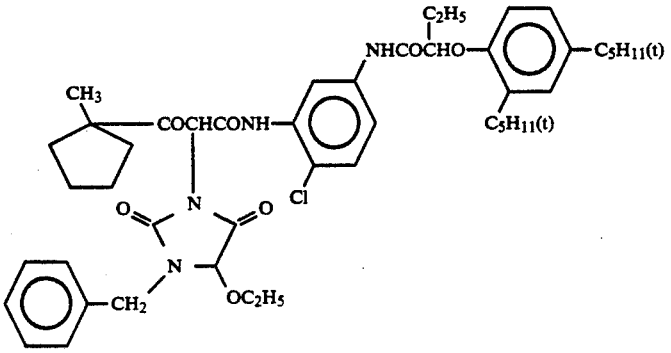

Specific examples of other yellow couplers which can be used are illustrated below.

(Y-1)
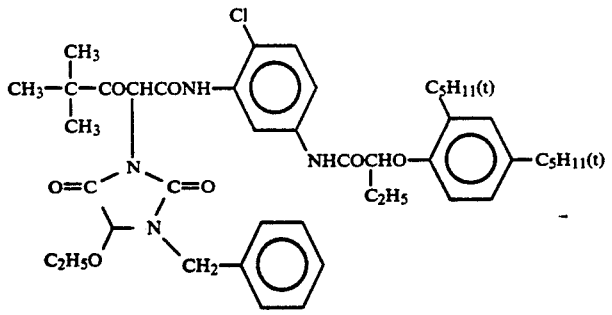
(Y-2)
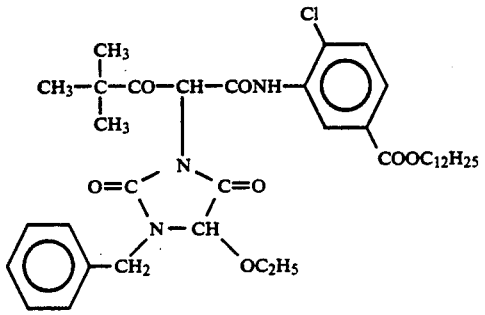
(Y-3)
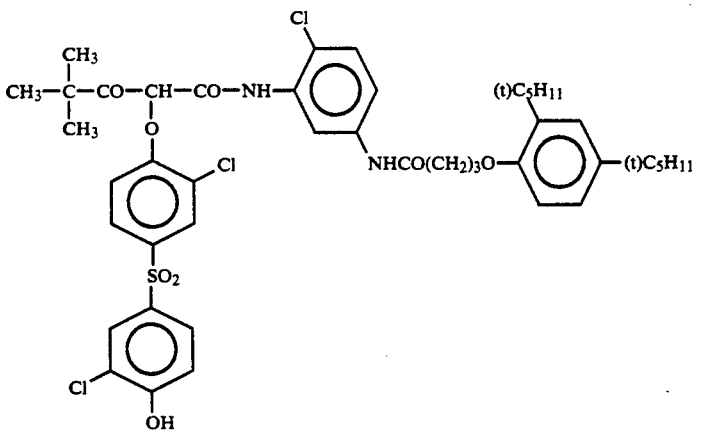
(Y-4)
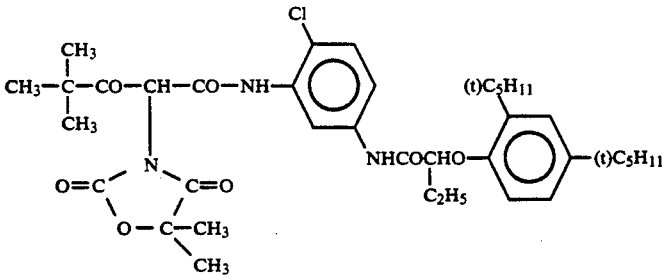
(Y-5)
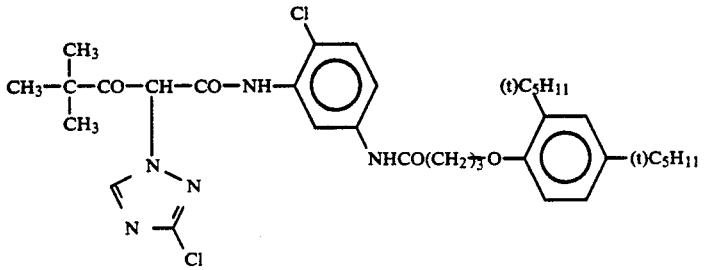

-continued
(Y-6)
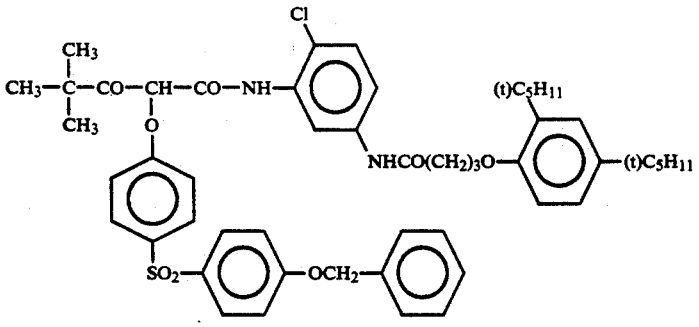
(Y-7)
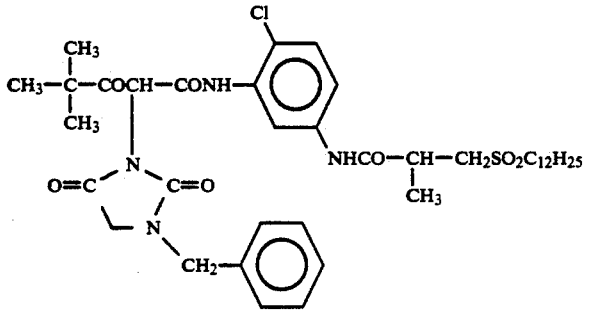
(Y-8)
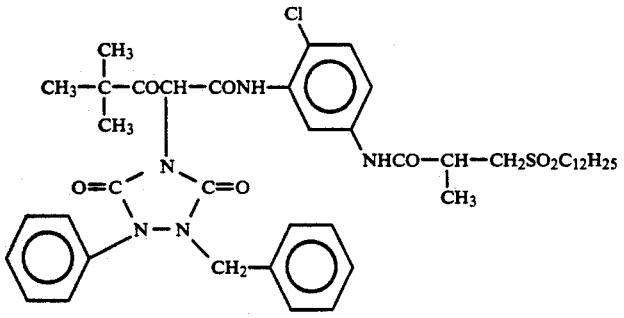
(Y-9)
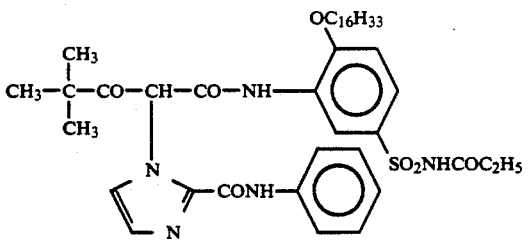
(Y-10)
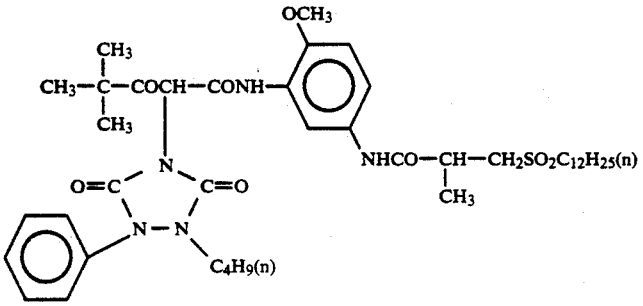

-continued (Y-11)

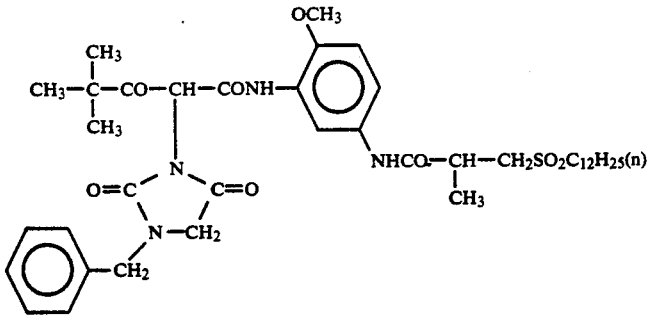

(Y-12)

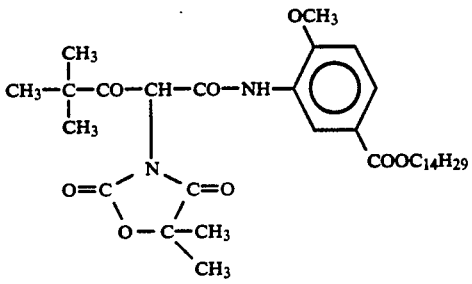

(Y-13)

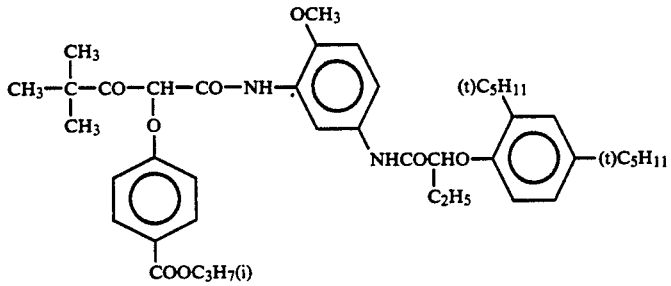

(Y-14)

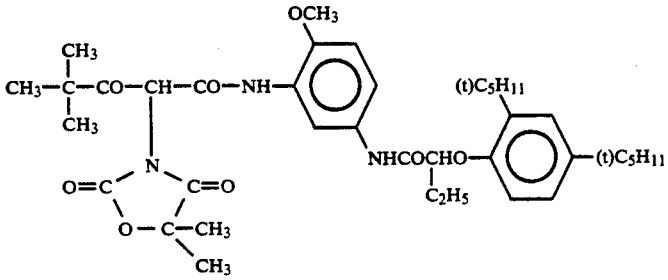

Each of the couplers represented by the foregoing general formulae (Ia), (Ib), (Ic), and yellow couplers of, e.g., the acylacetanilide type is incorporated into a silver halide emulsion layer, which is a constituent of the light-sensitive layer, in an amount of generally from 0.1 to 1.0 mole, preferably from 0.1 to 0.5 mole, per mole of silver halide present in the silver halide emulsion layer into which the coupler is incorporated.

In incorporating the above-described couplers into the light-sensitive layer, various known methods can be applied. In general, the incorporation can be carried out using an oil-in-water dispersion method known as an oil protect method, which comprises dissolving a coupler in a solvent, and dispersing the dissolved coupler into a surfactant-containing aqueous gelatin solution in the form of emulsion; or adding water or an aqueous gelatin solution to a surfactant-containing coupler solution, and causing phase inversion therein to make the mixture into an oil-in-water dispersion. In the case of alkali-soluble couplers, on the other hand, the Fischer dispersion method can be employed. Further, when a low boiling organic solvent is used and then removed from a coupler dispersion by distillation, noodle washing, ultrafiltration or so on, the resulting dispersion may be mixed with a photographic emulsion.

As for the dispersion medium for the couplers cited above, high boiling organic solvents having a dielectric constant of 2–20 (at 25° C.) and a refractive index of 1.5–1.7 (at 25° C.) and/or water-insoluble high molecular compounds are advantageously used.

High boiling organic solvents which can be preferably used include those represented by the following formulae (A), (B), (C), (D) and (E), respectively.

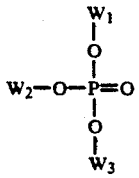

(A)

$W_1—COO—W_2$ (B)

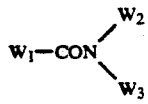

(C)

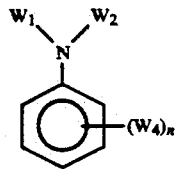

(D)

$W_1—O—W_2$ (E)

In the above formulae, $W_1$, $W_2$ and $W_3$ each represents a substituted or unsubstituted alkyl, cycloalkyl, alkenyl, aryl or heterocyclic group; $W_4$ represents $W_1$, $OW_1$, or $SW_1$; n represents an integer from 1 to 5, and when n is 2 or above plural $W_4$'s may be the same or different. Further, $W_1$ and $W_2$ may combine with each other to form a condensed ring.

In addition to those high boiling point solvents represented by formulae (A) to (E), compounds which have a melting point of 100° C. or below and a boiling point of 140° C. or above, and are immiscible with water are good solvents for couplers and can also be adopted as high boiling organic solvents used in this invention. It is desirable that the high boiling organic solvents used in this invention should have a melting point of 80° C. or below, and a boiling point of 160° C. or above, particularly 170° C. or above.

Details of these high boiling organic solvents are described in JP-A-62-215272, from the right lower column on page 137 to the right upper column on page 144.

Another method of incorporating the above described couplers into emulsion layers comprises impregnating a loadable latex polymer (as disclosed, e.g., in U.S. Pat. No. 4,203,716) with couplers with or without the high boiling organic solvents described above, or dissolving couplers in a polymer insoluble in water but soluble in an organic solvent, and then dispersing the resulting polymer solution into a hydrophilic colloid solution in an emulsified condition.

Polymers which can be preferably used in the above-described method include homo- or copolymers disclosed in WO 88/00723, on pages 12 to 30. In particular, acrylamide type polymers are favored over others with respect to, e.g., stabilization of color images.

The light-sensitive material prepared in accordance with this invention may contain as color fog inhibitors hydroquinone derivatives, aminophenol derivatives, gallic acid derivatives, ascorbic acid derivatives and the like.

In the light-sensitive material of this invention, various kinds of discoloration inhibitors can be used. Typical examples of organic discoloration inhibitors usable for cyan, magenta and/or yellow images include hindered phenols such as hydroquinones, 6-hydroxychromans, 5-hydroxycoumarans, spirochromans, p-alkoxyphenols and bisphenols; gallic acid derivatives; methylenedioxybenzenes; aminophenols; hindered amines; and ether or ester derivatives obtained by silylating or alkylating the phenolic OH groups contained in the above-cited compounds, respectively. In addition, metal complexes represented by (bissalicylaldoxmato)-nickel complex and (bis-N,N-dialkyldithiocarbamato)-nickel complexes can be also used for the above-described purpose.

Specific examples of organic discoloration inhibitors are described in the following patent specifications.

That is, hydroquinones are described, e.g., in U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromans, 5-hydroxycoumarans and spirochromans are described, e.g., in U.S. Pat. Nos. 3,432,300, 3,573,050, 3,574,627, 3,698,909 and 3,764,337, and JP-A-52-152225; spiroindanes are described, e.g., in U.S. Pat. No. 4,360,589; p-alkoxyphenols are described, e.g., in U.S. Pat. No. 2,735,765, British Patent 2,066,975, JP-A-59-10539 and JP-B-57-19765 (The term "JP-B" as used herein means an "examined Japanese patent publication"); hindered phenols are described, e.g., in U.S. Pat. No. 3,700,455, JP-A-52-2224, U.S. Pat. No. 4,228,235, and JP-B-52-6623; gallic acid derivatives, methylenedioxybenzenes and amino-phenols are described, e.g., in U.S. Pat. No. 3,457,079, U.S. Pat. No. 4,332,886 and JP-B-56-21144, respectively; hindered amines are described, e.g., in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344; and metal complexes are described, e.g., in U.S. Pat. Nos. 4,050,938 and 4,241,155, and British Patent 2,027,731(A). These compounds are effective when used in a proportion of, in general, from 5 to 100 wt % to couplers corresponding thereto, and emulsified together therewith, followed by incorporation into the light-sensitive layers.

In order to prevent cyan dye images from deteriorating due to heat, and light in particular, it is more effective to introduce an ultraviolet absorbent into a cyan color-forming layer and both layers adjacent thereto.

Examples of ultraviolet absorbents usable for the above-described purpose include aryl-substituted benzotriazole compounds (as disclosed, e.g., in U.S. Pat. No. 3,533,794), 4-thiazolidone compounds (as disclosed, e.g., in U.S. Pat. Nos. 3,314,794 and 3,352,681), benzophenone compounds (as disclosed, e.g., in JP-A-46-2784), cinnamate compounds (as disclosed, e.g., U.S. Pat. Nos. 3,705,805 and 3,707,395), butadiene e.g., in U.S. Pat. No. 4,045,229), and benzoxidol compounds (as disclosed, e.g., in U.S. Pat. Nos. 3,406,070, 3,677,672 and 4,271,307). Also, ultraviolet-absorbing couplers (e.g., α- naphthol type cyan dye-forming couplers) and ultraviolet- absorbing polymers may be employed. These ultraviolet absorbents may be mordanted in order to be fixed to a particular layer.

Of the above ultraviolet absorbents, the aryl-substituted benzotriazole compounds are preferred.

In particular, it is preferred that the following compounds are used together with the above-described couplers, especially the pyrazoloazole type couplers.

Specifically, compounds of the kind which can produce chemically inert, substantially colorless compounds by chemically bonding to an aromatic amine developing agent remaining after the color development-processing (Compounds F) and/or compounds of the kind which can produce chemically inert, substantially colorless compounds by chemically bonding to an oxidized aromatic amine developing agent remaining after the color development-processing (Compounds G) are used individually or in combination to prevent the generation of stain and other side effects from occurring upon storage after photographic processing, which is due to formation of dyes through the reaction between couplers and an unoxidized color developing agent or an oxidation product of the color developing agent remaining in the photographic film after photographic processing.

Compound F is preferably a compound capable of undergoing a reaction with p-anisidine wherein the rate constant of the second order reaction, $k_2$ (at 80° C. in trioctyl phosphate) is from 1.0 l/mol.sec to $1\times10^{-5}$ l/mol.sec. The rate constant of the second order reaction can be measured by the method described in JP-A-63-158545.

When $k_2$ is greater than the upper value of the above range, the compound itself becomes unstable, and there is a possibility that the compound will decomposed by a reaction with gelatin or water. On the other hand, when $k_2$ is smaller than the lower value of the above range, the reaction of the compound with the remaining (residual) aromatic amine developing agent is slow. As a result, undesirable side effects of the remaining (residual) aromatic amine developing agent can not be prevented.

Of the compounds F, compounds represented by the following formula (FI) or (FII) are preferred.

$$R_1-(A)n-X \quad \text{(FI)}$$

$$R_2-\underset{\underset{B}{|}}{C}=Y \quad \text{(FII)}$$

In the above formulae, $R_1$ and $R_2$ each represents an aliphatic, aromatic or heterocyclic group; n represents 1 or 0; A represents a group capable of forming a chemical bond by reacting with an aromatic amine developing agent; X represents a group capable of splitting off upon reaction with an aromatic primary amine developing agent; B represents a hydrogen atom, an aliphatic group, an aromatic group, a heterocyclic group, an acyl group, or a sulfonyl group; and Y represents a group capable of accelerating the addition of an aromatic amine developing agent to the compound of formula (FII). $R_1$ and X in formula (FI), and Y and $R_2$ or B in formula (FII) may be combined with each other to form a cyclic structure.

Typical examples of reactions in which the compounds (FI) and (FII) chemically bond with remaining (residual) aromatic amine developing agents are a substitution reaction and an addition reaction.

Specific examples of the compounds represented by formulae (FI) and (FII) include those disclosed in JP-A-63-158545, JP-A-62-283338, European Patent Laid-Open Nos. 298,321 and 277,589, etc.

On the other hand, of the Compounds (G) which can chemically bond to an oxidation product of an aromatic amine developing agent remaining after color development to produce a chemically inert, colorless compound, compounds represented by the following formula (GI) are preferred.

$$R-Z \quad \text{(GI)}$$

In formula (GI), R represents an aliphatic group, an aromatic group, or a heterocyclic group; and Z represents a nucleophilic group, or a group capable of releasing a nucleophilic group through decomposition in the light-sensitive material. In the compounds represented by formula (GI), it is desirable that Z is a group having a Pearson's nucleophilic "$CH_3I$" value (R. G. Pearson, et al., J. Am. Chem. Soc., 90, 319 (1968)) of 5 or more, or a group derived therefrom.

Suitable examples of compounds represented by formula (GI include compounds disclosed in European Patent Laid-Open No. 255,722, JP-A-62-143048, JP-A-62-229145, JP-A-1-230039, JP-A-1-57259, European Patent Laid-Open Nos. 298,321 and 277,589, etc.

In addition, details of the combination of compounds G with compounds F are disclosed in European Patent Laid-Open No. 277,589.

The light-sensitive material prepared in accordance with this invention may contain in hydrophilic colloid layers water-soluble dyes or dyes which can be rendered soluble in water by photographic processing for various purposes, such as prevention of irradiation and halation. Such dyes include oxonol dyes, hemioxonol dyes, styryl dyes, merocyanine dyes, cyanine dyes and azo dyes. In particular, oxonol dyes, hemioxonol dyes and merocyanine dyes are preferred.

For the binder or protective colloid which can be used for emulsion layers of light-sensitive material of this invention, gelatin is preferred. Of course, other hydrophilic colloids can be employed independently, or together with gelatin.

Gelatin which can be used in this invention includes not only lime-processed gelatin, but also acid-processed gelatin. Details of methods for preparing gelatins are described in Arthur Weiss, *The Macromolecular Chemistry of Gelatin,* Academic Press (1964).

As the support in the light-sensitive material of this invention, both transparent films used in conventional photographic light-sensitive materials, such as cellulose nitrate film, polyethylene terephthalate film and the like, and reflective supports can be used. However, reflective support is preferred.

The term "reflective support" as used herein describes a support which can make the dye images formed in silver halide emulsion layers clear due to its high reflectivity. Such a reflective support includes a support covered with a hydrophobic resin in which a light-reflecting substance, such as titanium oxide, zinc oxide, calcium carbonate, calcium sulfate or the like, is dispersed, and a support made from a hydrophilic resin in which a light-reflecting substance is dispersed therein. Specific examples thereof include baryta paper, polyethylene-coated paper, polypropylene type synthetic paper, and transparent supports provided with a reflective layer or containing reflective substances. Usable transparent supports include a glass plate, polyester films such as a polyethylene terephthalate film, a cellulose triacetate film, a cellulose nitrate film, a polyamide film, a polycarbonate film, a polystyrene film, a vinyl chloride resin, etc.

As other reflective supports, those which have a metallic surface with specular reflectivity or diffusional reflectivity of the second order can be used. It is desirable that the metallic surface has a spectral reflectivity of 0.5 or above in the visible region, and should be rendered diffusionally reflective by making the surface coarse or diffuse using metal powders. Examples of the metal for the metal powder include aluminum, tin, silver, magnesium, or alloys of two or more of these metals. The metallic surface may be the surface of a metallic plate, foil or thin film formed using, e.g., a rolling, a vacuum deposition or a galvanizing technique. In particular, it is desirable to form a reflective support by evaporating a thin metallic film onto a nonmetallic substrate.

On the metallic surface, it is desirable to provide a layer of a water-resisting resin, especially a thermoplastic resin. In addition, the support should preferably be provided with an antistatic layer on the side of the support opposite to the side having the metallic surface. Details of such supports are described, e.g., in JP-A-61-210346, JP-A-63-24247, JP-A-63-24251 and JP-A-63-24255.

The support to be used in this invention can be chosen properly depending on the purpose of the photographic material.

As for the light-reflecting substance, white pigment which has been thoroughly kneaded in the presence of a surfactant is preferably used. Further, it is desirable that individual surfaces of the pigment grains are treated with a di- to tetrahydric alcohol.

The occupied area ratio (%) of the fine grains of white pigment per specified unit area can be determined by subdividing an observed area into adjacent unit areas measuring 6 μm by 6 μm, and measuring the occupied area ratio (Ri %) of the projected fine grains in each unit area. The variation coefficient of the proportions of the occupied areas can be determined as a ratio ($s/\overline{R}$) of the standard deviation of Ri (represented by s) to the mean value of Ri (represented by $\overline{R}$). The number of unit areas to be examined is preferably at least 6.

That is to say, the variation coefficient, $s/\overline{R}$, can be determined according to the following representation:

$$\sqrt{\frac{\sum_{i=1}^{n}(Ri-\overline{R})^2}{n-1}} \Big/ \frac{\sum_{i=1}^{n} Ri}{n-1}$$

The variation coefficient of the the occupied area ratio of the pigment fine grains is preferably 0.15 or less, particularly 0.12 or less. When the ratio is below 0.08, the dispersion of grains is considerred substantially uniform.

The color photographic light-sensitive material of this invention is preferably subjected to color development, bleach-fixing and rinsing (or stabilization) treatments. However, bleaching and fixing may be carried out separately, without a monobath (bleach-fixing) treatment.

The color developer used in this invention contains a known aromatic primary amine color developing agent. Preferred color developing agents include p-phenylenediamine compounds. Typical examples of p-phenylenediamine compounds are described below. However, the invention should not be construed as being limited to these compounds.

D-1—N,N-diethyl-p-phenylenediamine,
D-2—2-amino-5-diethylaminotoluene,
D-3—2-amino-5-(N-ethyl-N-laurylamino)toluene,
D-4—4-[N-ethyl-N-(β-hydroxyethyl)amino]aniline,
D-5—2-methyl-4-[N-ethyl-N-(β-hydroxyethyl-)amino]aniline,
D-6—4-amino-3-methyl-N-ethyl-N-[β-(methanesulfonamido)ethyl]aniline,
D-7—N-(2-amino-5-diethylaminophenylethyl)methanesulfonamide,
D-8—N,N-dimethyl-p-phenylenediamine,
D-9—4-amino-3-methyl-N-ethyl-N-methoxyethylaniline,
D-10—4-amino-3-methyl-N-ethyl-N-β-ethoxyethylaniline,
D-11—4-amino-3-methyl-N-ethyl-N-β-butoxyethylaniline.

Of the above-cited p-phenylenediamine compounds, 4-amino-3-methyl-N-ethyl-N-[β-(methanesulfonamido)-ethyl]aniline (D-6) is particularly preferred.

These p-phenylenediamine compounds may be in the form of a salt, such as a sulfate, hydrochloride, sulfite or p-toluenesulfonate. A suitable amount of the aromatic primary amine developing agent is about 0.1 g to about 20 g, preferably about 0.5 g to about 10 g, per 1 l of developer.

In practicing this invention, it is desirable to use a developer containing substantially no benzyl alcohol. The expression "containing substantially no benzyl alcohol" as used herein refers to a benzyl alcohol concentration of 2 ml/l or less, more preferably 0.5 ml/l or less. In the most preferred case, benzyl alcohol is not contained at all.

It is more desirable that the developer in this invention contains substantially no sulfite ion. The sulfite ion not only functions as a preservative for a developing agent, but also functions to dissolve silver halides and lower dye-forming efficiency by the reaction with an oxidation product of the developing agent. These functions are presumed to be one of the causes of an increase in fluctuation of photographic characteristics, which accompanies continuous processing. The expression "contains substantially no sulfite ion" as used herein means that sulfite ion may be present in a concentration of $3.0\times10^{-3}$ mol/l or less and, most preferably, sulfite ion is not contained at all. In this invention, however, a very small quantity of sulfite ion may be used as an antifoggant for a processing kit in which a developing agent is concentrated prior to practical use.

It is desired, as described above, that a developer to be used in this invention should contain substantially no sulfite ion. It is even more desirable that the developer contains substantially no hydroxylamine also. This is because the variation in hydroxylamine concentration is thought to exert a great influence on photographic characteristics since hydroxylamine itself has silver development activity, as well as being a preservative. The expression "contains substantially no hydroxylamine" as used herein includes cases where hydroxylamine has a concentration of $5.0\times10^{-3}$ mol/l or less. In particular, the case where hydroxylamine is not contained at all is preferred.

It is more preferred that the developer used in this invention contain organic preservatives in place of the above-described hydroxylamine and sulfite ion.

The term "organic preservatives" refers to all organic compounds which can decrease the deterioration rate of aromatic primary amine color developing agents by addition to a processing solution for color photographic materials. More specifically, such compounds include those capable of preventing color developing agents from undergoing aerial oxidation or the like.

Examples of especially effective organic preservatives include hydroxylamine compounds (excluding hydroxylamine), hydroxamic acids, hydrazines, hydrazides, phenols, α-hydroxyketones, α-aminoketones, sugars, monoamides, diamines, polyamines, quaternary ammonium salts, nitroxyl radicals, alcohols, oximes, diamide compounds, condensed ring type amines and the like. Specific examples of these preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020, JP-B-48-30496, etc.

As other preservatives, various metals disclosed in JP-A-57-44148 and JP-A-57-53749, salicylic acids disclosed in JP-A-59-180588, alkanolamines disclosed in JP A-54-3532, polyethyleneimides disclosed in JP-A-56-94349, aromatic polyhydroxy compounds disclosed in U.S. Pat. No. 3,746,544, and others may be added, if needed. In particular, the addition of alkanolamines such as triethanolamine, dialkylhydroxylamines such as diethylhydroxylamine, hydrazine compounds or aromatic polyhydroxy compounds is preferred.

Of the above-cited organic preservatives, hydroxylamine compounds and hydrazine compounds (including hydrazines and hydrazides) are particularly preferred over others, and details of these compounds are described in JP-A-1-97953, JP-A-1-186939, JP-A-1-186940, and JP-A-1-187557, etc.

Further, the combined use of the above-described hydroxylamine or hydrazine compounds and amines is preferred for improving the stability of the color developer and, moreover, for improving stability during continuous processing.

Examples of amines used for the foregoing purpose include cyclic amines as disclosed in JP-A-63-239447, amines disclosed in JP-A-63-128340, and other amines disclosed in JP-A-1-186939 and JP-A-1-187557.

It is desirable in this invention that the color developer contains chlorine ion in a concentration of from $3.5\times10^{-2}$ to $1.5\times10^{-1}$ mol/l, particularly preferably from $4\times10^{-2}$ to $1\times10^{-1}$ mol/l. When the chlorine ion concentration is higher than $1.5\times10^{-1}$ mol/l, chlorine ion comes to retard development. Therefore, such a high chlorine ion concentration is undesirable for rapid processing and attainment of high maximum density, which is one of the objects of this invention. On the other hand, chlorine ion concentrations less than $3.5\times10^{-2}$ mol/l are undesirable for preventing fog.

In the practice of this invention, the color developer preferable contains bromine ion in a concentration of from $3.0\times10^{-5}$ to $1.0\times10^{-3}$ mol/l, preferably from $5.0\times10^{-5}$ to $5\times10^{-4}$ mol/l. When the bromine ion concentration is higher than $1\times10^{-3}$ mol/l, development is retarded, and further, the maximum density and sensitivity are lowered, whereas when it is lower than $3.0\times10^{-5}$ mol/l generation of fog cannot be prevented satisfactorily.

Chlorine ion and bromine ion may be added directly to the developer, or eluted from the light-sensitive materials into the developer during development-processing.

When chlorine ion is added directly to the color developer, substances which can be used for supplying chlorine ion include sodium chloride, potassium chloride, ammonium chloride, lithium chloride, nickel chloride, magnesium chloride, manganese chloride, calcium chloride, and cadmium chloride. Of these salts, sodium chloride and potassium chloride are preferred.

Also, chlorine ion may be supplied from a brightening agent added to the developer.

Substances which can be used for supplying bromine ion include sodium bromide, potassium bromide, ammonium bromide, lithium bromide, calcium bromide, magnesium bromide, manganese bromide, nickel bromide, cadmium bromide, cerium bromide and thallium bromide. Of these salts, potassium bromide and sodium bromide are preferred.

When eluting the ions from light-sensitive materials during development, both chlorine and bromine ions may be supplied from silver halide emulsions, or other emulsions.

The color developer used in this invention is preferably adjusted to pH 9–12, particularly pH 9–11.0. The color developer may further contain other known developer additives.

In order to maintain the pH of the color developer constant in the above-described range, it is desirable to use various pH buffers. Suitable examples of pH buffers include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, and others. Of these salts, carbonates, phosphates, tetraborates and hydroxybenzoates are particularly preferred because they are excellent in solubility and buffering capacity at a high pH of greater than 9.0, do not have any adverse effect on photographic properties (e.g., fog) when added to the color developer, and are not expensive.

Specific examples of these buffers include sodium carbonate, potassium carbonate, sodium hydrogen carbonate, potassium hydrogen carbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate, (sodium 5-sulfosalicylate), potassium 5-sulfo-2-hydroxybenzoate (potassium 5-sulfosalicylate), etc. However, buffers which can be used in this invention are not limited to these compounds.

It is desirable to add the foregoing buffers to the color developer in a concentration of 0.1 mol/l or above, particularly from 0.1 to 0.4 mol/l.

In addition, various kinds of chelating agents can be used in the color developer as a suspending agent for calcium and magnesium ions, or for the purpose of improving the stability of the color developer. For instance, nitrilotriacetic acid, diethylenetriamine-pentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycoletherdiaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and others can be used.

Two or more of these chelating agents may be used together, if desired.

These chelating agents are added in an amount sufficient to block metal ions from being present in the color developer. For example, the addition thereof in an amount of from about 0.1 to about 10 g per liter of the color developer is sufficient to block metal ions.

To the color developer, any development accelerators can be added, if needed.

Suitable development accelerators include thioether compounds disclosed in JP-B-37-16088, JP-B-37-5987, JP-B-38-7826, JP-B-44-12380, JP-B-45-9019 and U.S. Pat. No. 3,813,247, p-phenylenediamine compounds disclosed in JP-A-52-49829 and JP-A-50-15554, quaternary ammonium salts disclosed in JP-A-50-137726, JP-B-44-30074, JP-A- 56-156826 and JP-A-52-43429, amine compounds disclosed in U.S. Pat. Nos. 2,494,903, 3,128,182, 4,230,796 and 3,253,919, JP-B-41-11431, U.S. Pat. Nos. 2,482,546, 2,596,926 and 3,582,346, polyalkylene oxides disclosed in JP-B-37-16088, JP-B-42-25201, U.S. Pat. No. 3,128,183, JP-B-41-11431, JP-B-42-23883 and U.S. Pat. No. 3,532,501, 1-phenyl-2-pyrazolidones, imidazoles etc. can be added, if needed.

Any antifoggants can also be added in this invention, if needed. As an antifoggant, alkali metal halides such as sodium chloride, potassium bromide, potassium iodide and the like, and organic antifoggants can be used. Typical examples of organic antifoggants which can be used are nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine and adenine.

It is preferred that the color developers used in this invention contain brightening agents. As a brightening agent, 4,4'-diamino-2,2'-disulfostilbene compounds are used to advantage. These compounds are added in an amount of from 0 to 5 g, preferably from 0.1 to 4 g, per liter of the color developer.

Further, various kinds of surfactants, such as alkylsulfonic acids, arylsulfonic acids, aliphatic carboxylic acids and aromatic carboxylic acids, may be added, if desired.

The processing temperature of the color developer empolyed in this invention is from 20° to 50° C., preferably from 30° to 40° C. Processing time for the color developer is from 20 sec. to 5 min., preferably 30 sec. to 2 min.

It is desirable to use a replenisher in the least possible amount. The amount of replenisher to be used is appropriately 20 to 600 ml, preferably 50 to 300 ml, more preferably 60 to 200 ml, and most preferably 60 to 150 ml, per $m^2$ of the light-sensitive material processed.

The desilvering stage applicable to this invention is described below.

In general, the desilvering stage may consist of any steps, e.g., the combination of bleaching and fixing steps, fixing and bleach-fixing steps, bleaching and bleach-fixing steps, a bleach-fixing step alone, or other combinations.

A bleaching bath, a bleach-fixing bath and a fixer which can be used in this invention are described below.

Any bleaching agent can be used in a bleaching or bleach-fixing bath. In particular, complex salts of Fe(III) and organic acids (e.g., aminopolycarboxylic acids, such as ethylenediaminetetraacetic acid, diethylenetriaminepentaacetic acid, etc., aminopolyphosphonic acids, phosphonocarboxylic acids, organic phosphonic acids, and other organic acids such as citric acid, tartaric acid, malic acid, etc.); persulfates; hydrogen peroxide; and so on can be preferably used.

Of these bleaching agents, organic complex salts of Fe(III) are particularly favored for rapid processing and preventing environmental pollution. Examples of aminopolycarboxylic acids, aminopolyphosphonic acids, organic phosphonic acids, and salts thereof, which are useful for forming organic complex salts of Fe(III), include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, glycoletherdiaminetetraacetic acid, and so on. These acids may assume a salt form such as a sodium salt, a potassium salt, a lithium salt and an ammonium salt. Of these compounds, Fe(III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred over others because of their high bleaching power. These ferric ion complexes may be used in the form of a complex salt itself, or may be formed in a processing bath by adding both a ferric salt, e.g., ferric sulfate, ferric chloride, ferric nitrate, ammonium ferric sulfate, ferric phosphate or the like, and a chelating agent, such as an aminopolycarboxylic acid, an aminopolyphosphonic acid, a phosphonocarboxylic acid, etc. Moreover, such chelating agents may be used in excess of the amount needed to form their ferric ion complex salts. Of the ferric ion complexes, aminopolycarboxylic acid-Fe(III) complex salts are preferred, and they are added in an amount of from 0.01 to 1.0 mole, particularly from 0.05 to 0.50 mole, per liter of the processing bath.

In a bleaching bath, a bleach-fixing bath and/or a prebath thereof, various compounds can be used as a bleach accelerator. For example, the use of compounds containing a mercapto group or a disulfido linkage, as disclosed in U.S. Pat. No. 3,893,858, German Patent 1,290,812, JP-A-53-95630 and *Research Disclosure,* No. 17129 (July, 1978), thiourea compounds as disclosed in JP-B-45-8506, JP-A-52-20832, JP-A-53-32735 and U.S. Pat. No. 3,706,561, or halides such as iodine ion, bromine ion, and the like is preferred for attaining superior bleaching power.

In addition, a rehalogenating agent, such as a bromide (e.g., potassium bromide, sodium bromide, ammonium bromide), chloride (e.g., potassium chloride, sodium chloride, ammonium chloride), iodide (e.g., ammonium iodide) or the like, can be contained in the bleaching or bleach-fixing bath employed in the practice of this invention. Moreover, a pH buffering combination of one or more inorganic or organic acids, and an alkali metal or ammonium salt thereof may be added. Specific examples include borax, sodium metaborate, acetic acid, sodium acetate, sodium carbonate, potassium carbonate, phosphorous acid, phosphoric acid, sodium phosphate, citric acid, sodium citrate, tartaric acid and so on. A corrosion inhibitor such as ammonium nitrate, guanidine, etc. can be added, if desired.

A fixing agent used in a bleach-fixing bath or a fixer includes water-soluble silver halide solvents such as thiosulfates (e.g., sodium thiosulfate, ammonium thiosulfate), thiocyanates (e.g., sodium thiocyanate, ammonium thiocyanate), thioether compounds (e.g., ethylenebisthioglycolic acid, 3,6-dithia-1,8-octanediol), and thioureas or other known fixing agents. These compounds can be used alone or as a mixture of two or more. Also, a special bleach-fixing bath comprising a combination of the fixing agent disclosed in JP-A-55-155354 and a large quantity of halide such as potassium iodide can be employed. In this invention, the use of a thiosulfate, especially ammonium thiosulfate, as a fixing agent is favored.

The amount of fixing agent used per liter of processing bath preferably is from 0.3 to 2 moles, and more preferably from 0.5 to 1.0 mole. A suitable pH region of the bleach-fix bath or that of the fixer is from 3 to 10, particularly from 5 to 9.

In the bleach-fixing bath, various kinds of brightening agents, defoaming agents, surfactants, and organic solvents such as polyvinyl pyrrolidone, methanol and so on can further be contained.

The bleach-fixing bath and the fixer may contain, as preservatives, sulfite ion-releasing compounds such as sulfites (e.g., sodium sulfite, potassium sulfite, ammonium sulfite), bisulfites (e.g., ammonium bisulfite, sodium bisulfite, potassium bisulfite), metabisulfites (e.g., potassium metabisulfite, sodium metabisulfite, ammonium metabisulfite) and so on. These compounds are added in a concentration of from about 0.02 to about 0.05 mol/l, preferably from 0.04 to 0.40 mol/l, based on sulfite ion.

As for the preservatives, sulfites are generally used, but ascorbic acid, carbonyl-bisulfite adducts, carbonyl compounds, and others may be also added.

Further, buffers, brightening agents, chelating agents, defoaming agents, antimolds and so on may be added, if desired, to the bleach-fixing solutions and fixing solutions.

After the desilvering processing, which include fixing, bleach-fixing and like steps, washing and/or stabilization processing is generally carried out.

The volume of washing water required in the washing step can be determined depending on the characteristics of light-sensitive materials to be processed (e.g., the kinds of couplers incorporated therein), the purpose of the light-sensitive materials to be processed, the temperature of the washing water, the number of washing tanks (the number of stages), the replenishing system (e.g., countercurrent or direct flow), and various other conditions. Of these conditions, the relationship between the number of washing tanks and the volume of washing water in the multistage counter current process can be determined according to the methods described in *Journal of the Society of Motion Picture and Television Engineers,* volume 64, pages 248–253 (May 1955). In general, a desirable number of stages in the multistage counter current process is from 2 to 6, especially from 2 to 4.

According to the multistage counter current process, the volume of washing water can be sharply decreased. Specifically, it can be reduced, for example, to 0.5 to less than 1 liter per $m^2$ of the light-sensitive materials processed. Under these circumstances, the effects of this invention are produced remarkably.

However, the process has a disadvantage in that bacteria are grown in the tanks because of an increase in the residence time of water in the tanks. This results in suspended matter, which sticks to the light-sensitive materials processed therein. As a means of solving such a problem, the method of lowering calcium and magnesium ion concentrations, as disclosed in JP-A-62-288838, can be employed to great advantage. Further, bactericides such as isothiazolone compounds and thiabendazole compounds disclosed in JP-A-57-8542; chlorine-containing germicides such as sodium salt of chlorinated isocyanuric acid disclosed in JP-A-61-120145; and germicides such as benzotriazoles disclosed in JP-A-61-267761, copper ion, and those described in Hiroshi Horiguchi, *Bohkin Bohbai no Kaqaku* (which means "Antibacterial and moldproof chemistry"), Sankyo Shuppan (1986); *Biseibutsu no Mekkin Sakkin Bohbai Gijutsu* (which means "Arts of sterilizing and pasteurizing microbes, and proofing against molds"), compiled by Eisei Gijutsukai ("Sanitary Technique Siciety"), published by Kogyo Gijutsu Kai in 1982; and *Bohkin-Bohbaizai Jiten* (which means "Thesaurus of antibacteria and antimolds"), compiled by Nippon Bohkin Bohbai Gakkai ("Japanese Anti-bacterial and Antifungal Society, 1986").

In the washing water, surfactants as wetting agents, and chelating agents such as EDTA as water softener can additionally be used.

Subsequently to the above-described washing step, or directly after the desilvering processing without undergoing a washing step, light-sensitive materials can be processed with a stabilizer. Compounds having an image stabilizing function, e.g., aldehyde series compounds represented by formaldehyde, buffers for adjusting the processed films to a pH value suitable for stabilization of dyes, and ammonium compounds, are added to the slabilizer. Further, the foregoing various germicides and antimolds can be added thereto in order to prevent bacteria from propagating in the stabilizer, and to prevent mold in the processed light-sensitive materials.

Furthermore, a surfactant, a brightening agent and a hardener can be added, too. In subjecting the light-sensitive material of this invention directly to stabilization without carrying out any washing step, known methods, such as disclosed in JP-A-57-8543, JP-A-58-14834, JP-A-60-220435, can be adopted.

Moreover, chelating agents such as 1-hydroxyethylidene-1,1-diphosphonic acid, ethylenediaminetetramethylenephosphonic acid and the like, and magnesium and bismuth compounds can be used to advantage in the stabilizing bath.

A so-called rinsing solution can likewise be used as washing water or as stabilizing solution to be used after the desilvering processing.

A suitable pH for the washing or stabilizing step is from 4 to 10, more preferably from 5 to 8. The temperature varies depending on the characteristics and the intended use of the light-sensitive materials to be processed, but generally is from 15° C. to 45° C., preferably from 20° C. to 40° C. The time can also be arbitrarily chosen, but it is more advantageous to finish the washing or stabilization step in a short time in order to reduce the overall processing time. A suitable time is from 15 seconds to 1 minute and 45 seconds, more preferably from 30 seconds to 1 minute and 30 seconds. From the standpoints of running cost, reduction of wastes, handling facility, etc., it is more desirable that the washing or stabilizing bath should be replenished at a smaller rate.

A desirable replenishment rate per unit area ranges from 0.5 to 50 times, preferably from 3 to 40 times, the quantity of the processing solution brought from the prebath per unit area of the light-sensitive material. In other words, it is below 1 liter, preferably below 500 ml, per $m^2$ of light-sensitive material. Replenishment may be carried out either continuously or intermittently.

The solution used in the washing and/or stabilization step can further be used in a prior step. For instance, the overflow of washing water, which is reduced in the multistage countercurrent system, is made to flow into a bleach-fixing bath arranged as the prebath, and the bleach-fixing bath is replenished by a concentrated solution, resulting in a reduction of waste solution.

This invention will now be illustrated in more detail by reference to the following examples. However, the invention should not be construed as being limited to these examples.

EXAMPLE 1

Preparation of Sample 101

After the surface of a paper support laminated by polyethylene on both sides was subjected to corona discharge, it was coated with sodium dodecylbenzenesulfonate-containing gelatin to form a subbing layer, and thereon were further coated various constituent layers to prepare a multilayer color photographic paper, designated as Sample 101, having the following layer structure. Coating solutions used therein were prepared in the manner described below.

Preparation of Coating Solution for First Layer:

A mixture of 19.1 g of a yellow coupler (ExY), 4.4 g of a color image stabilizer (Cpd-1) and 0.7 g of a color image stabilizer (Cpd-7)was dissolved in a mixed solvent consisting of 27.2 ml of ethyl acetate, 4.1 g of solvent (Solv-3) and 4.1 g of solvent (Solv-7), and then dispersed in an emulsified condition into 185 ml of a 10 wt% aqueous gelatin solution containing 8 ml of a 10 wt% solution of sodium dodecylbenzenesulfonate. Thus, an emulsified dispersion A was prepared. On the other hand, two kinds of silver chlorobromide emulsions (both of which had a cubic form; one of which had an average grain size of 0.88 μm and a variation coefficient of 0.08 with respect to the grain size distribution, and the other of which had an average grain size of 0.70 μm and a variation coefficient of 0.10 with respect to the grain size distribution; both of which contained 0.3 mol% silver bromide in such a condition as to be localized at part of the grain surface) were prepared. The blue-sensitive sensitizing dyes A and B, the structural formulae of which are illustrated below, were added to the large grain size emulsion in the same amount of $2.0\times10^{-4}$ mole per mole silver, and to the small grain size emulsion in the same amount of $2.5\times10^{-4}$ mole per mole of silver. They were chemically ripened with a sulfur sensitizer and a gold sensitizer. The thus prepared emulsions were mixed together in a ratio of the large-size emulsion to the small-size emulsion of 3:7 by mole, based on silver. The resulting emulsion is referred to as silver chlorobromide emulsion A. This emulsion A was mixed homogeneously with the foregoing emulsified dispersion A, and added thereto were other ingredients described below so as to obtain the coating solution for the first layer having the composition described below.

Coating solutions for the second to seventh layers were prepared in the same manner as the first layer. In each layer, sodium salt of 1-oxy-3,5-dichloro-s-triazine was used as a hardener.

Further, Cpd-10 and Cpd-11 were added to each layer in such an amount as to have total coverages of 25.0 mg/m² and 50.0 mg/m², respectively.

Spectral sensitizing dyes used in the silver chlorobromide emulsion of each light-sensitive emulsion layer are illustrated below.

Sensitizing Dye A for Blue-sensitive Emulsion Layer

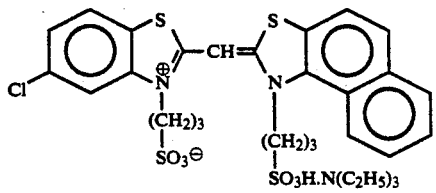

Sensitizing Dye B for Blue-sensitive Emulsion Layer

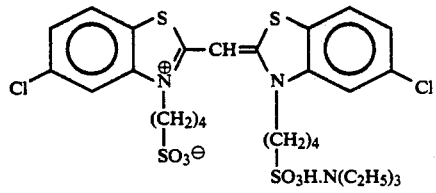

Both were added to the large grain size emulsion employed in emulsion A in an amount of $2.0\times10^{-4}$ mol/mol Ag, and to the small grain size emulsion employed in emulsion A in an amount of $2.5\times10^{-4}$ mol/mol Ag.

Sensitizing Dye C for Green-sensitive Emulsion Layer

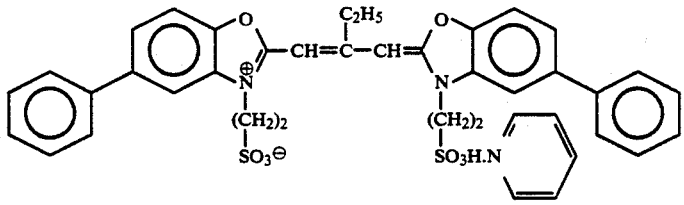

Dye C was added to a large grain size emulsion employed in emulsion B (an average grain size of 0.55 μm) in an amount of $4.0\times10^{-4}$ mol/mol Ag, and to a small grain size emulsion employed in emulsion B (an average grain size of 0.39 μm) in an amount of $5.6\times10^{-4}$ mol/mol Ag.

Sensitizing Dye D for Green-sensitive Emulsion Layer

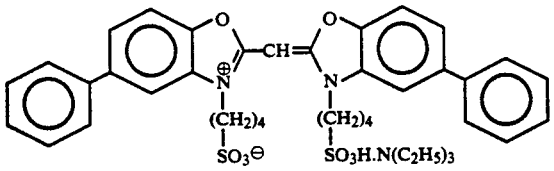

Dye D was added to the large grain size emulsion employed in emulsion B in an amount of $7.0\times10^{-5}$ mol/mol Ag, and to the small grain size emulsion employed in emulsion B in an amount of $1.0\times10^{-5}$ mol/mol Ag.

Sensitizing Dye E for Red-sensitive Emulsion Layer

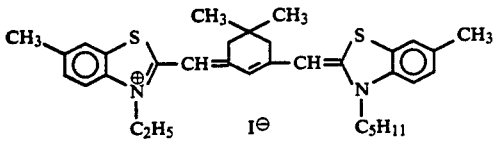

Dye E was added to the large grain size emulsion employed in emulsion C (an average grain size of 0.58 μm) in an amount of $0.9\times10^{-4}$ mol/mol Ag, and to the small grain size emulsion employed in emulsion C (an average grain size of 0.45 μm) in an amount of $1.1\times10^{-4}$ mol/mol Ag.

To the red-sensitive emulsion layer, the following compound was added in an amount of $2.6\times10^{-3}$ mole per mole of silver halide:

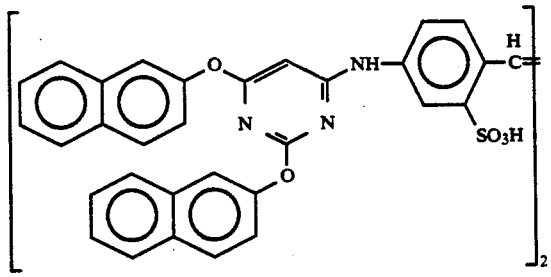

In addition, 1-(5-methylureidophenyl)-5-mercaptotetrazole was added to the blue-sensitive, the green-sensitive and the red-sensitive emulsion layers in amounts of $8.5\times10^{-5}$ mole, $7.7\times10^{-4}$ mole and $2.5\times10^{-4}$ mole, respectively, per mole of silver halide. Moreover, 4-hydroxy-6-methyl-1,3,3a,7-tetraazaindene was added to the blue-sensitive and the green-sensitive emulsion layers in amounts of $1\times10^{-4}$ mole and $2\times10^{-4}$ mole, respectively, per mole of silver halide.

The dyes illustrated below (each figure in parentheses represented the amount of each dye) were added to the emulsion layers in order to inhibit irradiation.

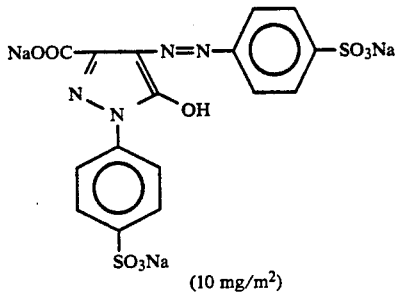

(10 mg/m²)

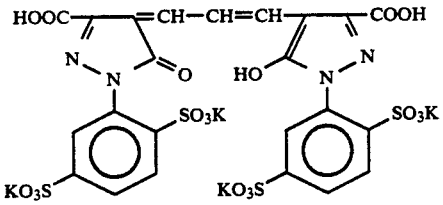

(10 mg/m²)

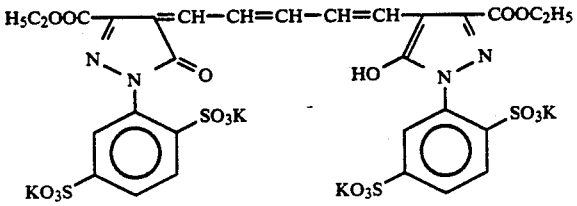

(40 mg/m²)

and

-continued

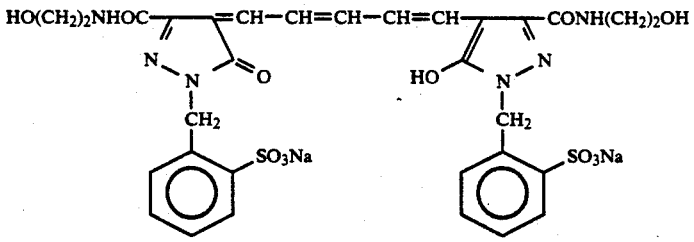

(20 mg/m²)

The composition of each constituent layer is described below. Each number on the right side represents the coated amount (g/m²) of the ingredient corresponding thereto. As for the silver halide emulsion, the number represents the coated amount based on silver.

Support

Polyethylene-laminated paper which contained white pigment ($TiO_2$) and a bluish dye (ultramarine) in the polyethylene on the side of the first layer

| | |
|---|---|
| First layer (blue-sensitive layer): | |
| Silver chlorobromide emulsion A described above | 0.30 |
| Gelatin | 1.75 |
| Yellow coupler (ExY) | 0.86 |
| Color image stabilizer (Cpd-1) | 0.19 |
| Solvent (Solv-3) | 0.18 |
| Solvent (Solv-7) | 0.18 |
| Color image stabilizer (Cpd-7) | 0.06 |
| Second layer (color stain inhibiting layer): | |
| Gelatin | 0.99 |
| Color stain inhibitor (Cpd-5) | 0.08 |
| Solvent (Solv-1) | 0.16 |
| Solvent (Solv-4) | 0.08 |
| Third layer (green-sensitive layer): | |
| Silver chlorobromide emulsion B (having cubic grains, and being a 1:3 (Ag mol ratio) mixture of an emulsion having an average grain size of 0.55 μm and a variation coefficient of 0.10 with respect to grain size distribution and an emulsion having an average grain size of 0.39 μm and a variation coefficient of 0.08 with respect to grain size distribution; each contained 0.8 mol % of AgBr in such a condition as to be localized at part of the grain surface) | 0.12 |
| Gelatin | 1.24 |
| Magenta coupler (ExM) | 0.23 |
| Color image stabilizer (Cpd-2) | 0.03 |
| Color image stabilizer (Cpd-3) | 0.16 |
| Color image stabilizer (Cpd-4) | 0.02 |
| Color image stabilizer (Cpd-9) | 0.02 |
| Solvent (Solv-2) | 0.40 |
| Fourth layer (ultraviolet absorbing layer): | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| Fifth layer (red-sensitive layer): | |
| Silver chlorobromide emulsion C (having cubic grains, and being a 1:4 (Ag mol ratio) mixture of an emulsion having an average grain size of 0.58 μm and a variation coefficient of 0.09 with respect to grain size distribution and an emulsion having an average grain size of 0.45 μm and a variation coefficient of 0.11 with respect to grain size distribution, which each contained 0.6 mol % of AgBr in such a condition as to be localized at part of the grain surface) | 0.23 |
| Gelatin | 1.34 |
| Cyan coupler (ExC) | 0.35 |
| Color image stabilizer (Cpd-2) | 0.03 |
| Color image stabilizer (Cpd-4) | 0.02 |
| Color image stabilizer (Cpd-6) | 0.18 |

-continued

| | |
|---|---|
| Color image stabilizer (Cpd-7) | 0.40 |
| Color image stabilizer (Cpd-8) | 0.05 |
| Solvent (Solv-6) | 0.14 |
| Sixth layer (ultraviolet absorbing layer): | |
| Gelatin | 0.53 |
| Ultraviolet absorvent (UV-1) | 0.16 |
| Color stain inhibitor (Cpd-5) | 0.02 |
| Solvent (Solv-5) | 0.08 |
| Seventh layer (protective layer): | |
| Gelatin | 1.33 |
| Acryl-modified polyvinyl alcohol copolymer (modification degree: 17%) | 0.17 |
| Liquid paraffin | 0.03 |

(ExY) Yellow Coupler

1:1:0.5 (by mole) mixture of (a)

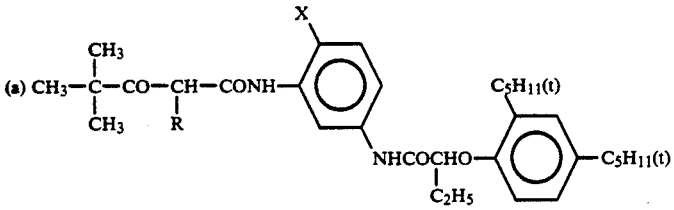

where R =

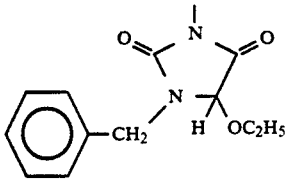

and X = Cl and (b) same as (a) except R =

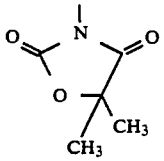

and X = $OCH_3$ and (c)

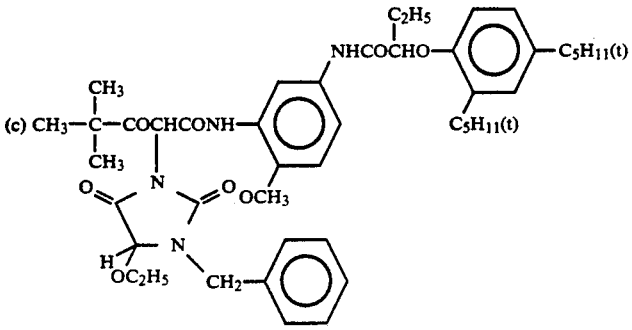

(ExM) Magenta Coupler

-continued
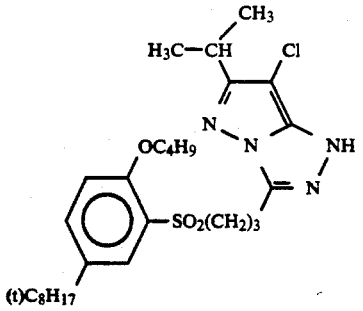
(ExC) Cyan Coupler
1:1 (by mole) mixture of
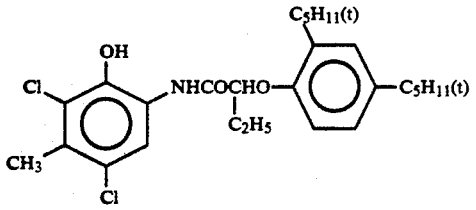
and
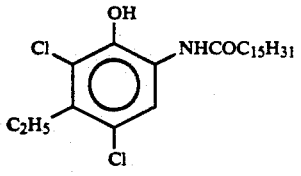
(Cpd-1) Color Image Stabilizer
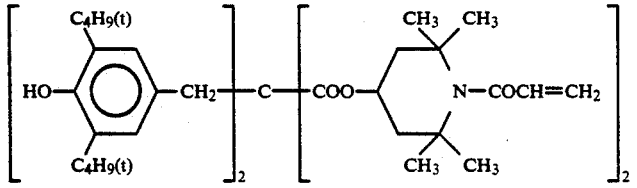
(Cpd-2) Color Image Stabilizer
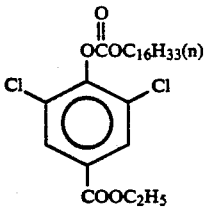
(Cpd-3) Color Image Stabilizer
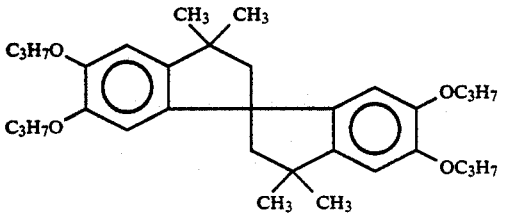
(Cpd-4) Color Image Stabilizer -continued
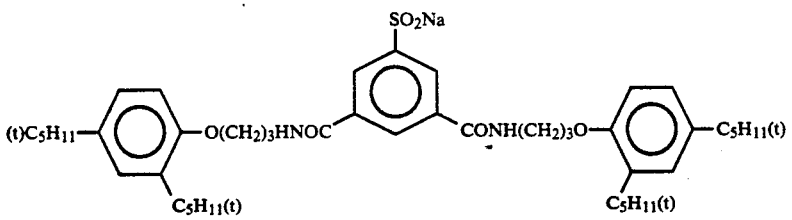
(Cpd-5) Color Stain Inhibitor
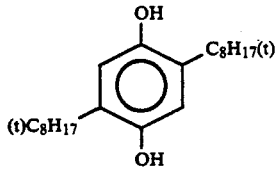
(Cpd-6) Color Image Stabilizer
2:4:4 (by weight) mixture of
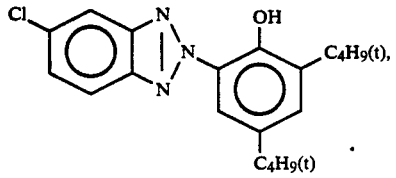
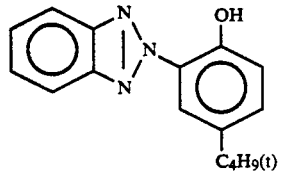
and
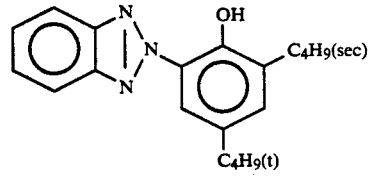
(Cpd-7) Color Image Stabilizer
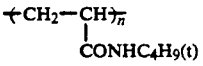
Average molecular weight 60,000
(Cpd-8) Color Image Stabilizer
1:1 (by weight) mixture of
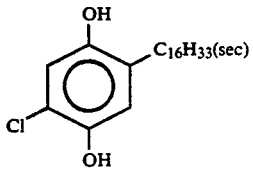
and
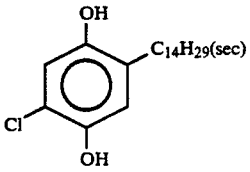
(Cpd-9) Color Image Stabilizer -continued
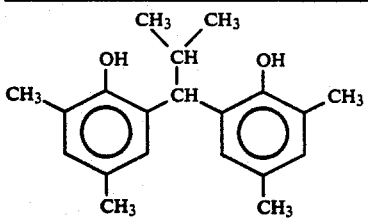
(Cpd-10) Antiseptic
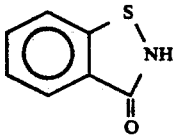
(Cpd-11) Antiseptic
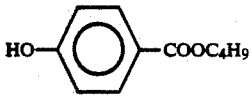
(UV-1) Ultraviolet Absorbent
4:2:4 (by weight) mixture of
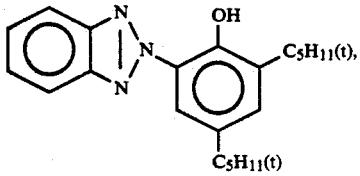
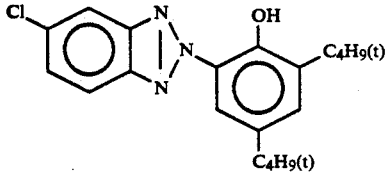
and
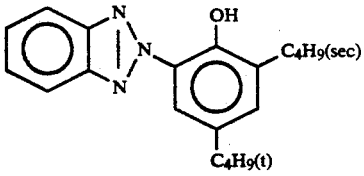
(Solv-1) Solvent
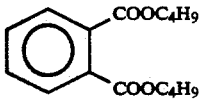
(Solv-2) Solvent
1:1 (by volume) mixture of
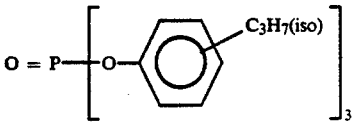
and -continued

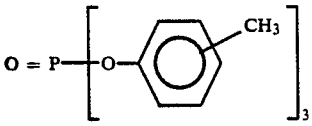

(Solv-3) Solvent $O=P[O-C_9H_{19}(iso)]_3$ (Solv-4) Solvent

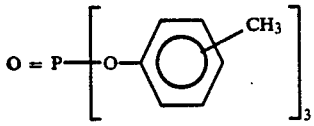

(Solv-5) Solvent

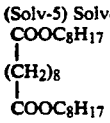

(Solv-6) Solvent
80:20 (by volume) mixture of

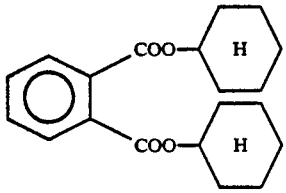

and

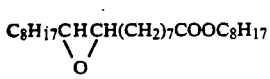

(Solv-7) Solvent

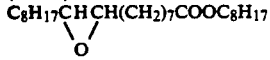

Preparation of Samples 102 to 110

Samples were prepared in the same manner as Sample 101, except that the magenta coupler in the third layer and the cyan coupler in the fifth layer were replaced by equimolar amounts of couplers as set forth in Table 1.

Using a conventional negative film with a photographed subject, the subject image was printed in these samples, and developed using an automatic developing machine. Prior to development, in order to evaluate the extent of color reproduction, Sample 101 was subjected to a running test until the amount of the replenisher used became twice the volume of the tank used for color development.

Processing steps and formulas of processing solutions used are described below.

The thus obtained images were observed under a light source to evaluate the extent of color reproduction.

Each of the samples shown in Table 1 was subjected to wedgewise exposure for sensitometry through a blue, green or red separation filter, by means of a sensitometer (Model FWH, produced by Fuji Photo Film Co. Ltd., equipped with a light source having a color temperature of 3,200° K.). The exposure time was set to 0.1 sec., and the exposure was controlled to 250 CMS. After exposure, each sample was subjected to the same photographic processing as adopted in evaluation of color reproduction. The processed samples were irradiated with a xenon light source (180,000 lux) for 4 days. A density after irradiation in the magenta image area having a density of 1.0 before irradiation was used as a measure of the keeping quality of the magenta dye image.

| Processing Step | Temperature | Time | Amount* replenished | Tank Volume |
|---|---|---|---|---|
| Color development | 35° C. | 45 sec. | 161 ml | 17 l |
| Bleach-fixing | 30–35° C. | 45 sec. | 215 ml | 17 l |
| Rinsing (1) | 30–35° C. | 20 sec. | — | 10 l |
| Rinsing (2) | 30–35° C. | 20 sec. | — | 10 l |
| Rinsing (3) | 30–35° C. | 20 sec. | 350 ml | 10 l |
| Drying | 70–80° C. | 60 sec. | | |

*per $m^2$ of light-sensitive material (The rinsing step was carried out according to a 3-stage counter current process in the direction of from tank 3 to tank 1)

The composition of each processing solution used is described below.

Tank

-continued

| Color Developer: | Solution | Replenisher |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoanilinesulfate | 5.0 g | 7.0 g |
| N,N-Bis(carboxymethyl)-hydrazine | 4.0 g | 5.0 g |
| Sodium N,N-di(sulfoethyl)-hydroxylamine | 4.0 g | 5.0 g |
| Brightening agent (WHITEX 4B, produced by Sumitomo Chemical Co., Ltd.) | 1.0 g | 2.0 g |
| Water to make | 1,000 ml | 1,000 ml |
| pH (25° C.) adjusted to | 10.05 | 10.45 |

Bleach-Fixing Bath (Tank solution = Replenisher):

| | |
|---|---|
| Water | 400 ml |
| Ammonium thiosulfate (70 wt/v %) | 100 ml |
| Ammonium sulfite | 17 g |
| Ammonium ethylenediaminetetraacetonatoferrate(III) | 55 g |
| Disodium ethylenediaminetetraacetate | 5 g |
| Ammonium bromide | 40 g |
| Water to make | 1,000 ml |
| pH (25° C.) adjusted to | 5.8 |

Rinsing Solution

Tank solution=Replenisher

Ion exchanger water (concentration of calcium and magnesium were each 3 ppm or less).

expressed as mole per mole of silver halide contained in the same layer.

| | | |
|---|---|---|
| First Layer (Antihalation Layer): | | |
| Black colloidal silver | silver | 0.18 |
| Gelatin | | 1.0 |
| Second Layer (Interlayer): | | |
| 2,5-Di-t-pentadecylhydroquinone | | 0.18 |
| EX-1 | | 0.035 |
| EX-3 | | 0.020 |
| EX-12 | | $2.0 \times 10^{-3}$ |
| U-1 | | 0.060 |
| U-2 | | 0.080 |
| U-3 | | 0.10 |
| HBS-1 | | 0.10 |
| HBS-2 | | 0.020 |
| Gelatin | | 1.04 |
| Third Layer (First Red-Sensitive Emulsion Layer): | | |
| Emulsion A | silver | 0.25 |
| Emulsion B | silver | 0.25 |
| Sensitizing dye I | | $6.9 \times 10^{-5}$ |
| Sensitizing dye II | | $1.8 \times 10^{-5}$ |
| Sensitizing dye III | | $3.1 \times 10^{-4}$ |
| EX-2 | | 0.34 |
| EX-10 | | 0.020 |
| U-1 | | 0.070 |
| U-2 | | 0.050 |
| U-3 | | 0.070 |
| HBS-1 | | 0.060 |
| Gelatin | | 0.87 |
| Fourth Layer (Second Red-Sensitive Emulsion Layer): | | |
| Emulsion G | silver | 1.00 |
| Sensitizing dye I | | $5.1 \times 10^{-5}$ |
| Sensitizing dye II | | $1.4 \times 10^{-5}$ |
| Sensitizing dye III | | $2.3 \times 10^{-4}$ |
| EX-2 | | 0.40 |
| EX-3 | | 0.050 |
| EX-10 | | 0.015 |
| U-1 | | 0.070 |
| U-2 | | 0.050 |
| U-3 | | 0.070 |
| Gelatin | | 1.30 |
| Fifth Layer (Third Red-Sensitive Emulsion Layer): | | |
| Emulsion D | silver | 1.60 |
| Sensitizing dye I | | $5.4 \times 10^{-5}$ |
| Sensitizing dye II | | $1.4 \times 10^{-5}$ |
| Sensitizing dye III | | $2.4 \times 10^{-4}$ |
| EX-2 | | 0.097 |
| EX-3 | | 0.010 |
| EX-4 | | 0.080 |
| HBS-1 | | 0.22 |
| HBS-2 | | 0.10 |
| Gelatin | | 1.63 |
| Sixth Layer (Interlayer): | | |
| EX-5 | | 0.040 |
| HBS-1 | | 0.020 |
| Gelatin | | 0.80 |
| Seventh Layer (First Green-Sensitive Emulsion Layer): | | |
| Emulsion A | silver | 0.15 |
| Emulsion B | silver | 0.15 |
| Sensitizing dye IV | | $3.0 \times 10^{-5}$ |
| Sensitizing dye V | | $1.0 \times 10^{-4}$ |
| Sensitizing dye VI | | $3.8 \times 10^{-4}$ |

TABLE 1

| Sample No. | Magenta Coupler in the Third Layer | Cyan Coupler in the Fifth Layer | Color Reproduction* | Light Fastness of Magenta Color Image | Note |
|---|---|---|---|---|---|
| 101 | ExM | ExC | Control | 0.51 | Comparison |
| 102 | II-14 | ExC | ≈ | 0.92 | Comparison |
| 103 | ExM | Coupler (26) | ○ | 0.52 | Comparison |
| 104 | II-14 | Coupler (1) | ◎ | 0.93 | Invention |
| 105 | II-14 | Coupler (2) | ◎ | 0.93 | Invention |
| 106 | II-14 | Coupler (4) | ◎ | 0.92 | Invention |
| 107 | II-14 | Coupler (26) | ○ | 0.92 | Invention |
| 108 | II-14 | Coupler (28) | ○ | 0.92 | Invention |
| 109 | II-12 | Coupler (1) | ◎ | 0.90 | Invention |
| 110 | II-13 | Coupler (1) | ◎ | 0.92 | Invention |

*Color reproduction was classified as follows, compared with that of Sample 101: ≈: equivalent; ○: good; ◎: superior As can be seen from Table 1, Sample 103 (using the combination disclosed in U.S. Pat. No. 4,960,685) was insufficient in light fastness of the magenta color image although it had improved color reproduction. In contrast, the samples of this invention were not only improved in color reproduction but also increased the light fastness of the magenta color image.

EXAMPLE 2

On a cellulose triacetate film support provided with a subbing layer, layers having the following compositions were coated to prepare a multilayer color photographic material, which is designated as Sample 201.

Compositions of Constituent Layers

Each figure on the right side represents amount ($g/m^2$) of the ingredient. As for the silver halide emulsions, the corresponding figures represent amounts based on silver. The amounts of sensitizing dyes are -continued

| | | |
|---|---|---|
| EX-1 | | 0.021 |
| I-20 | | 0.28 |
| EX-7 | | 0.015 |
| EX-8 | | 0.025 |
| HBS-1 | | 0.10 |
| HBS-3 | | 0.010 |
| Gelatin | | 0.59 |
| Eighth Layer (Second Green-Sensitive Emulsion Layer): | | |
| Emulsion C | silver | 0.45 |
| Sensitizing dye IV | | $2.1 \times 10^{-5}$ |
| Sensitizing dye V | | $7.0 \times 10^{-5}$ |
| Sensitizing dye VI | | $2.6 \times 10^{-4}$ |
| I-20 | | 0.10 |
| EX-7 | | 0.013 |
| EX-8 | | 0.018 |
| HBS-1 | | 0.16 |
| HBS-3 | | $8.0 \times 10^{-3}$ |
| Gelatin | | 0.50 |
| Ninth Layer (Third Green-Sensitive Emulsion Layer): | | |
| Emulsion E | silver | 1.20 |
| Sensitizing dye IV | | $3.5 \times 10^{-5}$ |
| Sensitizing dye V | | $8.0 \times 10^{-5}$ |
| Sensitizing dye VI | | $3.0 \times 10^{-4}$ |
| EX-1 | | 0.025 |
| I-17 | | 0.07 |
| I-22 | | 0.06 |
| EX-13 | | 0.015 |
| HBS-1 | | 0.25 |
| HBS-2 | | 0.10 |
| Gelatin | | 1.54 |
| Tenth Layer (Yellow Filter Layer): | | |
| Yellow colloidal silver | silver | 0.050 |
| EX-5 | | 0.080 |
| HBS-1 | | 0.030 |
| Gelatin | | 0.95 |
| Eleventh Layer (First Blue-Sensitive Emulsion Layer): | | |
| Emulsion A | silver | 0.080 |
| Emulsion B | silver | 0.070 |
| Emulsion F | silver | 0.070 |
| Sensitizing dye VII | | $3.5 \times 10^{-4}$ |

-continued

| | | |
|---|---|---|
| EX-8 | | 0.042 |
| EX-9 | | 0.75 |
| HBS-1 | | 0.20 |
| Gelatin | | 1.10 |
| Twelfth Layer (Second Blue-Sensitive Emulsion Layer): | | |
| Emulsion G | silver | 0.45 |
| Sensitizing dye VII | | $2.1 \times 10^{-4}$ |
| EX-9 | | 0.15 |
| EX-10 | | $7.0 \times 10^{-3}$ |
| HBS-1 | | 0.050 |
| Gelatin | | 0.78 |
| Thirteenth Layer (Third Blue-Sensitive Emulsion Layer): | | |
| Emulsion H | silver | 0.77 |
| Sensitizing dye VII | | $2.2 \times 10^{-4}$ |
| EX-9 | | 0.20 |
| HBS-1 | | 0.070 |
| Gelatin | | 0.69 |
| Fourteenth Layer (First Protective Layer): | | |
| Emulsion I | silver | 0.20 |
| U-4 | | 0.11 |
| U-5 | | 0.17 |
| HBS-1 | | $5.0 \times 10^{-2}$ |
| Gelatin | | 1.00 |
| Fifteenth Layer (Second Protective Layer): | | |
| H-1 | | 0.40 |
| B-1 (diameter: 1.7 μm) | | $5.0 \times 10^{-2}$ |
| B-2 (diameter: 1.7 μm) | | 0.10 |
| B-3 | | 0.10 |
| S-1 | | 0.20 |
| Gelatin | | 1.20 |

In addition to the foregoing ingredients, all the layers contained W-1, W-2, W-3, B-4, B5, F-1, F-2, F-3, F-4, F-5, F-6, F-7, F-8, F-9, F-10, F-11, F-12, F-13, iron salts, lead salts, gold salts, platinum salts, iridium salts and rhodium salts for the purpose of enhancing keeping quality, processability, pressure resistance, mold- and bacteria-proofing, antistatic property and coating facility.

EX-1

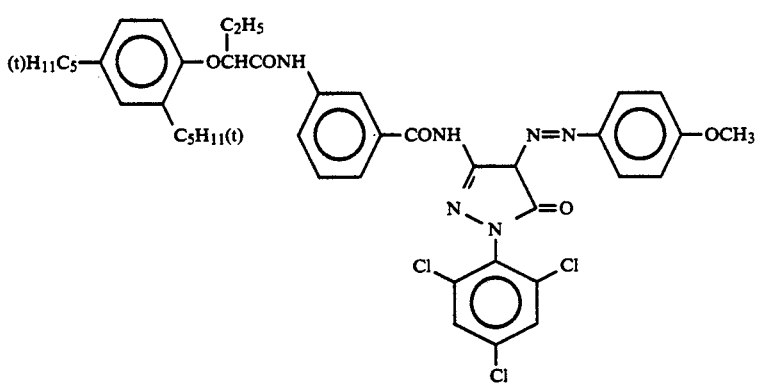

EX-2

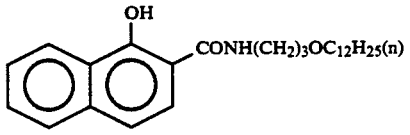

EX-3

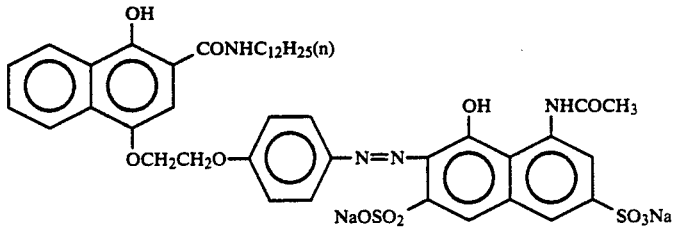

-continued
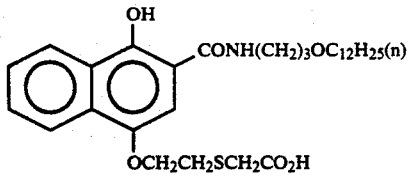
EX-4
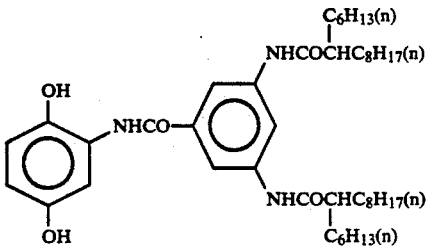
EX-5
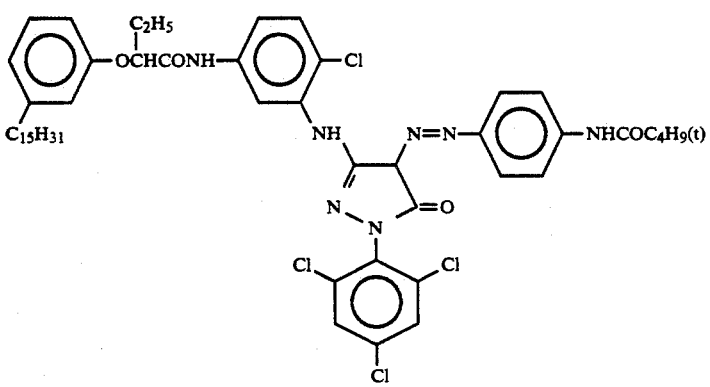
EX-7
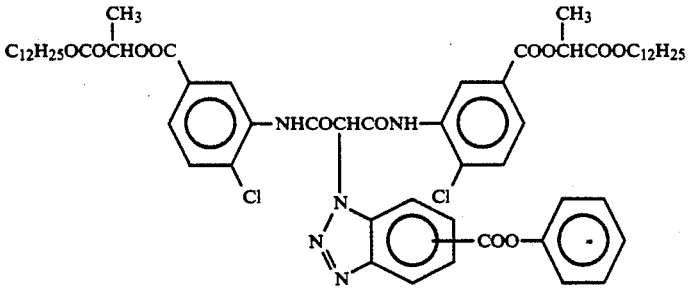
EX-8
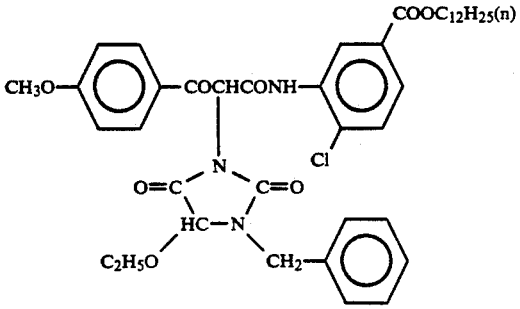
EX-9

-continued
EX-10
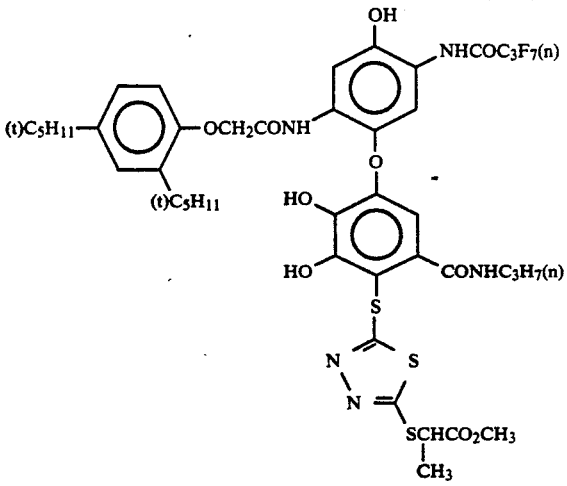
EX-12
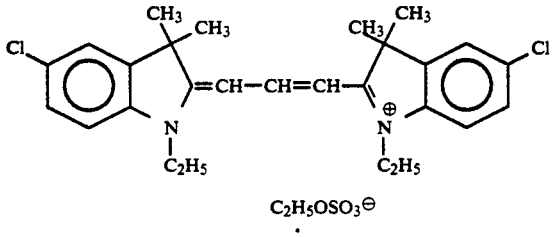
EX-13
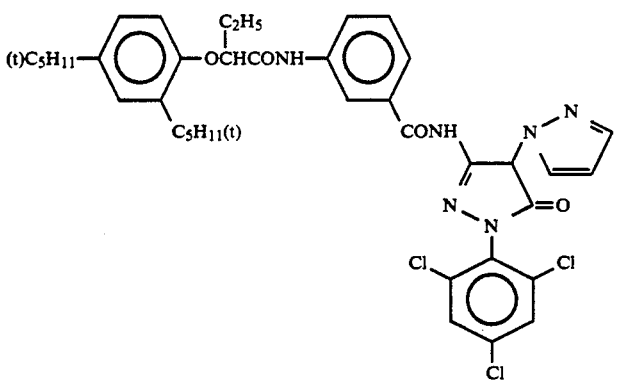
U-1
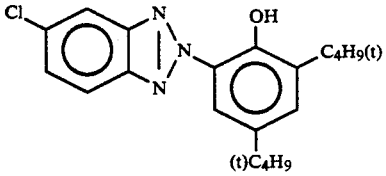
U-2
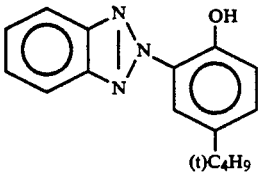
U-3
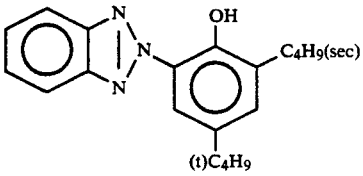

-continued

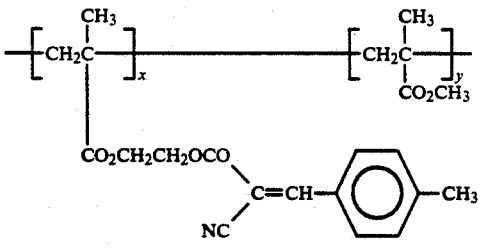

U-4 x:y = 70:30 (wt %)

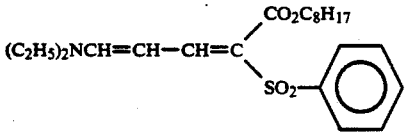

U-5

Tricresyl Phosphate HBS-1

Di-n-butyl Phthalate HBS-2

HBS-3

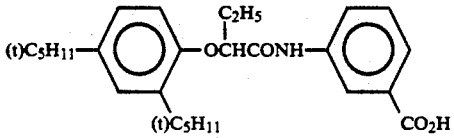

| | Average Content of AgI (mol %) | Average Grain Size (μm) | Variation Coefficient of Grain Size (%) | Ratio of Diameter to Thickness | Ratio between silver amounts (ratio between AgI amounts %) |
|---|---|---|---|---|---|
| Emulsion A | 4.0 | 0.45 | 27 | 1 | Core/Shell = 1/3 (13/1) Dual structure grains |
| Emulsion B | 8.9 | 0.70 | 14 | 1 | Core/Shell = 3/7 (25/2) Dual structure grains |
| Emulsion C | 10 | 0.75 | 30 | 2 | Core/Shell = 1/2 (24/3) Dual structure grains |
| Emulsion D | 16 | 1.05 | 35 | 2 | Core/Shell = 4/6 (40/0) Dual structure grains |
| Emulsion E | 10 | 1.05 | 35 | 3 | Core/Shell = 1/2 (24/3) Dual structure grains |
| Emulsion F | 4.0 | 0.25 | 28 | 1 | Core/Shell = 1/3 (13/1) Dual structure grains |
| Emulsion G | 14.0 | 0.75 | 25 | 2 | Core/Shell = 1/2 (42/0) Dual structure grains |
| Emulsion H | 14.5 | 1.30 | 25 | 3 | Core/Shell = 37/63 (34/3) Dual structure grains |
| Emulsion I | 1 | 0.07 | 15 | 1 | Uniform grains |

Sensitizing Dye I

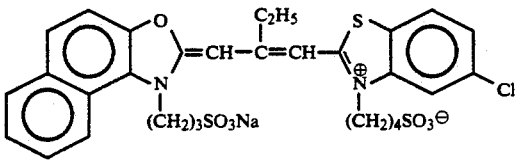

-continued

Sensitizing Dye II

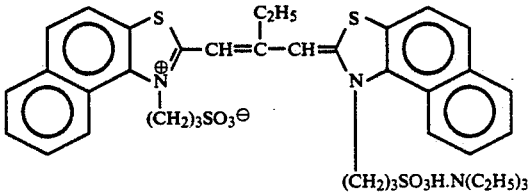

-continued
Sensitizing Dye III
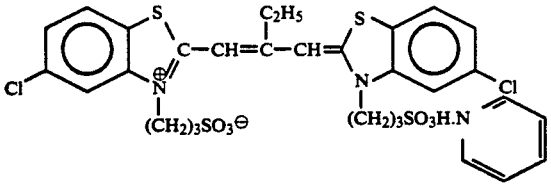
Sensitizing Dye IV
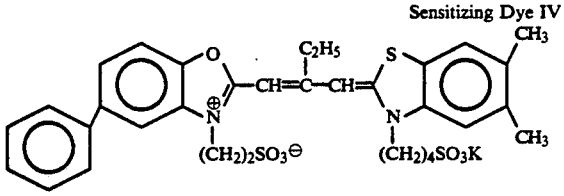
Sensitizing Dye V
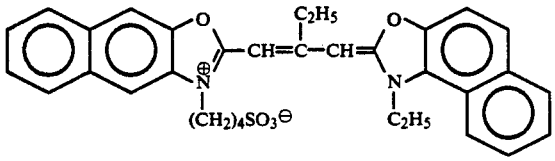
Sensitizing Dye VI
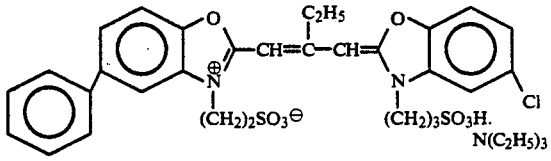
Sensitizing Dye VII
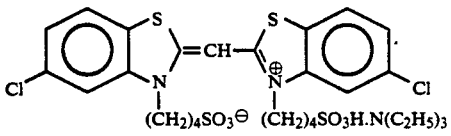
S-1
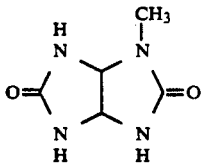
H-1
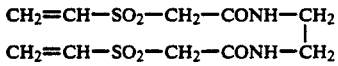
B-1
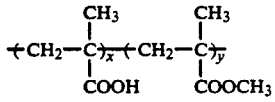
x/y = 10/90 (by weight)
B-2
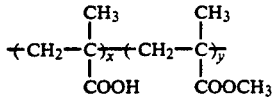
x/y = 40/60 (by weight)
-continued
B-3
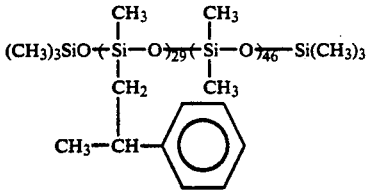
B-4
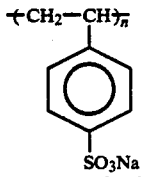
Average molecular weight: about 1,000,000
B-5
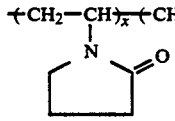
x/y = 70/30 (by weight)
W-1
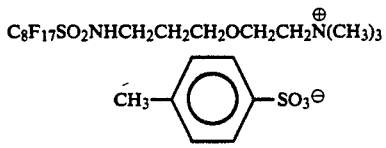
W-2
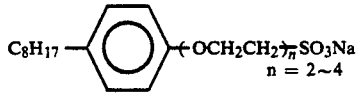
n = 2~4
W-3
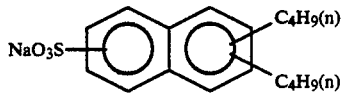
F-1
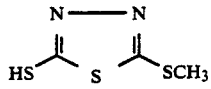
F-2
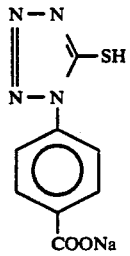
F-3
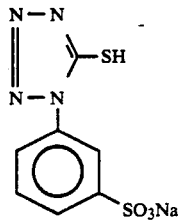

-continued

F-4

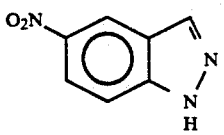

F-5

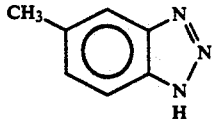

F-6

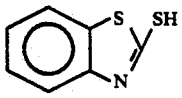

F-7

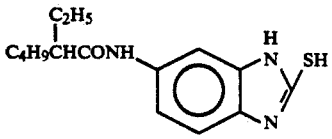

F-8

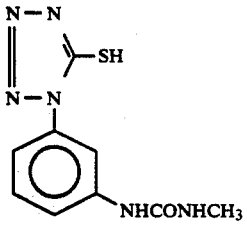

F-9

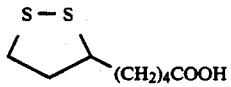

F-10

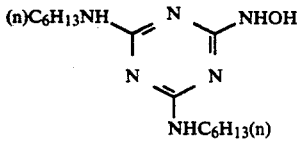

F-11

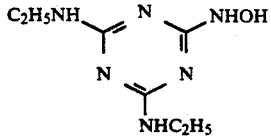

F-12

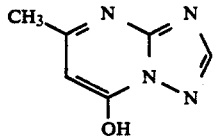

F-13

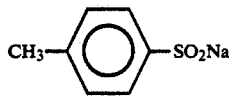

Preparation of Samples 202 to 207

These samples were prepared in the same manner as Sample 201, except that EX-2 in the first and the fourth layers, and EX-2 and EX-4 in the fifth layer were replaced by equimolar amounts of couplers as set forth in Table 2. The samples were each exposed to white light through an optical wedge, and then subjected to photographic processing described below.

Then, discoloration tests were carried out by allowing the thus processed samples to stand for 3 days at a temperature of 100° C. The storage keeping qualities of the cyan color images were evaluated by measuring the cyan color densities after the discoloration test in areas which had a cyan color density of 2.0 before the discoloration test, and determining dye remaining rates from the following equation:

$$\text{Dye remaining rate} = \frac{\text{Cyan color density after discoloration test}}{2.0} \times 100$$

Photographic Processing

| Processing Step | Time | Processing Temperature |
|---|---|---|
| Color Development | 3 min. 15 sec. | 38° C. |
| Bleaching | 1 min. 00 sec. | 38° C. |
| Bleach-Fixing | 3 min. 15 sec. | 38° C. |
| Washing (1) | 40 sec. | 35° C. |
| Washing (2) | 1 min. 00 sec. | 35° C. |
| Stabilization | 40 sec. | 38° C. |
| Drying | 1 min. 15 sec. | 55° C. |

The composition of each processing solution used was described below.

| | |
|---|---|
| Color Developer: | |
| Diethylenetriaminepentaacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-[N-methyl-N-β-hydroxyethylamino]-2-methylaniline sulfate | 4.5 g |
| Water to make | 1 l |
| pH adjusted to | 10.05 |
| Bleaching Bath: | |
| Ammonium ethylenediaminetetra-acetonato ferrate (III) dihydrate | 120.0 g |
| Disodium ethylenediaminetetraacetate | 10.0 g |
| Ammonium bromide | 100.0 g |
| Ammonium nitrate | 10.0 g |
| Bleach accelerator | 0.005 mole |

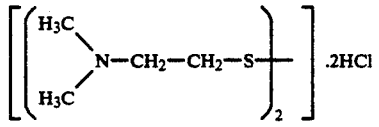

| | |
|---|---|
| Aqueous ammonia (27 wt %) | 15.0 ml |
| Water to make | 1.0 l |
| pH adjusted to | 6.3 |
| Bleach-Fix Bath: | |
| Ammonium ethylenediaminetetra-acetonato ferrate (III) dihydrate | 50.0 g |
| Disodium ethylenediaminetetraacetate | 5.0 g |
| Sodium sulfite | 12.0 g |
| Aqueous solution of ammonium thiosulfate (70 wt/v %) | 240.0 ml |
| Aqueous ammonia (27 wt %) | 6.0 ml |
| Water to make | 1.0 l |
| pH adjusted to | 7.2 |

Washing Water

Tap water was passed through a column of a mixed-bed system in which H-type strong acid cation-exchange resin (Amberlite IR-120B, produced by Rohm & Haas Co.) and OH-type anion-exchange resin (Amberlite IR-400, produced by Rohm & Haas Co.) were charged, resulting in a reduction of calcium and magnesium ion concentration each to 3 mg/l or less. To the thus purified water were added 20 mg/l of sodium dichloroisocyanurate and 0.15 g/l of sodium sulfate. The pH of this solution was within the range of 6.5 to 7.5.

| Stabilizing Bath: | |
|---|---|
| Formaldehyde (37 wt %) | 2.0 ml |
| Polyoxyethylene-p-monononylphenylether (average polymerization degree: 10) | 0.3 g |
| Disodium ethylenediaminetetraacetate | 0.05 g |
| Water to make | 1.0 l |
| pH adjusted to | 5.0–8.0 |

| Sample No. | 1st Layer | 2nd Layer | 5th Layer | | Keeping Quality of Cyan Color Image | Note |
|---|---|---|---|---|---|---|
| 201 | EX-2 | EX-2 | EX-2, | EX-4 | 88% | Comparison |
| 202 | (13) | (13) | (13) | (16) | 96% | Invention |
| 203 | (18) | (18) | (18) | (16) | 95% | Invention |
| 204 | (13) | (13) | (18) | (22) | 96% | Invention |

In accordance with the present invention, color photographic materials excellent in keeping quality of cyan color image were obtained.

EXAMPLE 3

Preparation of Sample 301

On a 127 μ-thick cellulose triacetate film support provided with a subbing layer, layers having the following compositions were coated in the order of description to prepare a multilayer color photographic material, designated as Sample 301. Each figure on the right side represents amount (g/m$^2$) of the ingredient. Effects of the compounds added should not be construed as being limited to the described uses thereof.

| | |
|---|---|
| First Layer: Antihalation Layer | |
| Black colloidal silver | 0.25 g |
| Gelatin | 1.9 g |
| Ultraviolet absorbent U-1 | 0.04 g |
| Ultraviolet absorbent U-2 | 0.1 g |
| Ultraviolet absorbent U-3 | 0.1 g |
| Ultraviolet absorbent U-4 | 0.1 g |
| Ultraviolet absorbent U-6 | 0.1 g |
| High boiling organic solvent Oil-1 | 0.1 g |
| Second Layer: Interlayer | |
| Gelatin | 0.40 g |
| Compound Cpd-D | 10 mg |
| High boiling organic solvent Oil-3 | 0.1 g |
| Dye D-4 | 0.4 mg |
| Third Layer: Interlayer | |
| Fine-grain silver iodobromide emulsion fogged in both surface and core (average grain size: 0.06 μm, variation coefficient: 18%, iodide content: 1 mol %) | silver 0.05 g |
| Gelatin | 0.4 g |
| Fourth Layer: Slow speed Red-sensitive Emulsion Layer | |
| Emulsion A | silver 0.2 g |
| Emulsion B | silver 0.3 g |
| Gelatin | 0.8 g |
| Coupler C-1 | 0.15 g |
| Coupler C-2 | 0.05 g |
| Coupler C-9 | 0.05 g |
| Compound Cpd-D | 10 mg |
| High boiling organic solvent Oil-2 | 0.1 g |
| Fifth Layer: Medium-speed Red-sensitive Emulsion Layer | |
| Emulsion B | silver 0.2 g |
| Emulsion C | silver 0.3 g |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| Sixth Layer: High-speed Red-sensitive Emulsion Layer | |
| Emulsion D | silver 0.4 g |
| Gelatin | 1.1 g |
| Coupler C-1 | 0.3 g |
| Coupler C-3 | 0.7 g |
| Additive P-1 | 0.1 g |
| Seventh layer: Interlayer | |
| Gelatin | 0.6 g |
| Additive M-1 | 0.3 g |
| Color stain inhibitor Cpd-K | 2.6 mg |
| Ultraviolet absorbent U-1 | 0.1 g |
| Ultraviolet absorbent U-6 | 0.1 g |
| Dye D-1 | 0.02 g |
| Eighth Layer: Interlayer | |
| Fine-grain silver iodobromide emulsion fogged in both surface and core (average grain size: 0.06 μm, variation coefficient: 16%, iodide content: 0.3 mol %) | silver 0.02 g |
| Gelatin | 1.0 g |
| Additive P-1 | 0.2 g |
| Color stain inhibitor Cpd-J | 0.1 g |
| Color stain inhibitor Cpd-A | 0.1 g |
| Ninth Layer: Slow-speed Green-sensitive Emulsion Layer | |
| Emulsion E | silver 0.3 g |
| Emulsion F | silver 0.1 g |
| Emulsion G | silver 0.1 g |
| Gelatin | 0.5 g |
| Coupler C-7 | 0.05 g |
| Coupler C-8 | 0.20 g |
| Compound Cpd-B | 0.05 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| High boiling organic solvent Oil-1 | 0.1 g |
| High boiling organic solvent Oil-2 | 0.1 g |
| Tenth Layer: Medium-speed Green-sensitive Emulsion Layer | |
| Emulsion G | silver 0.3 g |
| Emulsion H | silver 0.1 g |
| Gelatin | 0.6 g |
| Coupler C-7 | 0.2 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High boiling organic solvent Oil-2 | 0.01 g |
| Eleventh Layer: High-speed Green-sensitive Emulsion Layer | |
| Emulsion I | silver 0.5 g |
| Gelatin | 1.0 g |
| Coupler C-4 | 0.3 g |
| Coupler C-8 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High boiling organic solvent Oil-1 | 0.02 g |
| High boiling organic solvent Oil-2 | 0.02 g |
| Twelfth Layer: Interlayer | |
| Gelatin | 0.6 g |

-continued

| | |
|---|---|
| Dye D-1 | 0.1 g |
| Dye D-2 | 0.05 g |
| Dye D-3 | 0.07 g |
| Thirteenth Layer: Yellow Filter Layer | |
| Yellow colloidal silver | silver 0.1 g |
| Gelatin | 1.1 g |
| Color stain inhibitor Cpd-A | 0.01 g |
| High boiling organic solvent Oil-1 | 0.01 g |
| Fourteenth Layer: Interlayer | |
| Gelatin | 0.6 g |
| Fifteenth Layer: Slow-speed Blue-sensitive Emulsion Layer | |
| Emulsion J | silver 0.4 g |
| Emulsion K | silver 0.1 g |
| Emulsion L | silver 0.1 g |
| Gelatin | 0.8 g |
| Coupler C-5 | 0.6 g |
| Sixteenth Layer: Medium-speed Blue-sensitive Emulsion Layer | |
| Emulsion L | silver 0.1 g |
| Emulsion M | silver 0.4 g |
| Gelatin | 0.9 g |
| Coupler C-5 | 0.3 g |
| Coupler C-6 | 0.3 g |
| Seventeenth Layer: High-speed Blue-sensitive Emulsion Layer | |
| Emulsion N | silver 0.4 g |
| Gelatin | 1.2 g |
| Coupler C-6 | 0.7 g |
| Eighteenth Layer: First Protective Layer | |
| Gelatin | 0.7 g |
| Ultraviolet absorbent U-1 | 0.04 g |
| Ultraviolet absorbent U-2 | 0.01 g |
| Ultraviolet absorbent U-3 | 0.03 g |
| Ultraviolet absorbent U-4 | 0.03 g |
| Ultraviolet absorbent U-5 | 0.05 g |
| Ultraviolet absorbent U-6 | 0.05 g |
| High boiling organic solvent Oil-1 | 0.02 g |
| Formaldehyde scavenger Cpd-C | 0.2 g |
| Formaldehyde scavenger Cpd-I | 0.4 g |
| Dye D-3 | 0.05 g |
| Nineteenth Layer: Second Protective Layer | |
| Colloidal silver | silver 0.1 mg |
| Fine-grain silver iodobromide emulsion (average grain size: 0.06 μm, iodide content: 1 mol %) | silver 0.1 g |
| Gelatin | 0.4 g |
| Twentieth Layer: Third Protective Layer | |
| Gelatin | 0.4 g |
| Polymethylmethacrylate (average particle size: 1.5μ) | 0.1 g |
| Methylmethacrylate-acrylic acid (4:6 by weight) copolymer (average particle size: 1.5μ) | 0.1 g |
| Silicone oil | 0.03 g |

-continued

| | |
|---|---|
| Surfactant W-1 | 3.0 mg |
| Surfactant W 2 | 0.03 g |

In addition to the above-described ingredients, additives from F-1 to F-8 were added to every emulsion layer. Further, all the layers contained a gelatin hardener H-1, and surfactants W-3 and W-4 as a coating aid and emulsifiers. Furthermore, phenol, 1,2-benzisothiazoline- 3-one, 2-phenoxyethanol and phenetyl alcohol were added thereto as antiseptics and antimolds.

The silver iodobromide emulsions used in preparing Sample 301 were as follows:

| | Emulsion Name | Average grain size (μm) | Variation coefficient (%) | Iodide content (mol %) |
|---|---|---|---|---|
| A | Monodisperse tetradecahedral grains | 0.25 | 16 | 3.7 |
| B | Monodisperse cubic grains of internal latent-image type | 0.30 | 10 | 3.3 |
| C | Monodisperse tetradecahedral grains | 0.30 | 18 | 5.0 |
| D | Polydisperse twinned crystal grains | 0.60 | 25 | 2.0 |
| E | Monodisperse cubic grains | 0.17 | 17 | 4.0 |
| F | Monodisperse cubic grains | 0.20 | 16 | 4.0 |
| G | Monodisperse cubic grains of internal latent-image type | 0.25 | 11 | 3.5 |
| H | Monodisperse cubic grains of internal latent-image type | 0.30 | 9 | 3.5 |
| I | Polydisperse tabular grains (average aspect ratio: 4.0) | 0.80 | 28 | 1.5 |
| J | Monodisperse tetradecahedral grains | 0.30 | 18 | 4.0 |
| K | Monodisperse tetradecahedral grains | 0.37 | 17 | 4.0 |
| L | Monodisperse cubic grains of internal latent-image type | 0.46 | 14 | 3.5 |
| M | Monodisperse cubic grains | 0.55 | 13 | 4.0 |
| N | Polydisperse tabular grains (average aspect ratio: 7.0) | 1.00 | 33 | 1.3 |

The emulsions A to N wer spectrally sensitized as follows:

| Emulsion Name | Sensitizing Dye added | Amount added per mol of Ag | Time for Addition of Sensitizing Dyes |
|---|---|---|---|
| A | S-1 | 0.025 g | Just after chemical sensitization |
| | S-2 | 0.25 g | Just after chamical sensitization |
| B | S-1 | 0.01 g | Just after completion of grain formation |
| | S-2 | 0.25 g | Just after completion of grain formation |
| C | S-1 | 0.02 g | Just after chemical sensitization |
| | S-2 | 0.25 g | Just after chemical sensitization |
| D | S-1 | 0.01 g | Just after chemical sensitization |
| | S-2 | 0.10 G | Just after chemical sensitization |
| | S-7 | 0.01 g | Just after chemical sensitization |
| E | S-3 | 0.5 g | Just after chemical sensitization |
| | S-4 | 0.1 g | Just after chemical sensitization |
| F | S-3 | 0.3 g | Just after chemical sensitization |
| | S-4 | 0.1 g | Just after chemical sensitization |
| G | S-3 | 0.25 g | Just after completion of grain formation |
| | S-4 | 0.08 g | Just after completion of grain formation |
| H | S-3 | 0.2 g | During grain formation |
| | S-4 | 0.06 g | During grain formation |
| I | S-3 | 0.3 g | Just before start of chemical sensitization |
| | S-4 | 0.07 g | Just before start of chemical sensitization |
| | S-8 | 0.1 g | Just before start of chemical sensitization |
| J | S-6 | 0.2 g | During grain formation |
| | S-5 | 0.05 g | during grain formation |
| K | S-6 | 0.2 g | During grain formation |

-continued

| Emulsion Name | Sensitizing Dye added | Amount added per mol of Ag | Time for Addition of Sensitizing Dyes |
|---|---|---|---|
| | S-5 | 0.05 g | During grain formation |
| L | S-6 | 0.22 g | Just after the completion of grain formation |
| | S-5 | 0.06 g | Just after the completion of grain formation |
| M | S-6 | 0.15 g | Just after chemical sensitization |
| | S-5 | 0.04 g | Just after chemical sensitization |
| N | S-6 | 0.22 g | Just after completion of grain formation |
| | S-5 | 0.06 g | Just after completion of grain formation |

C-1

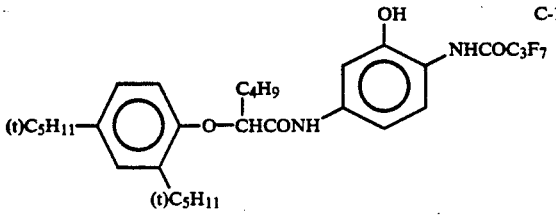

C-2

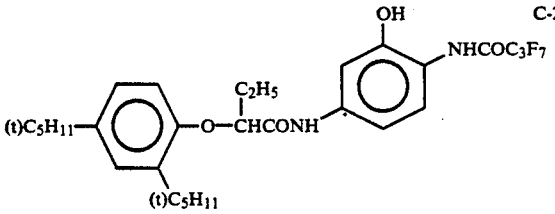

C-3

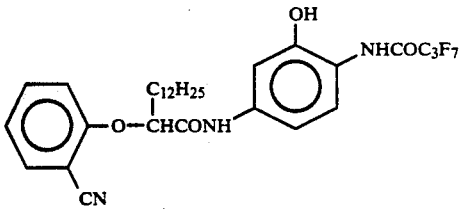

C-4

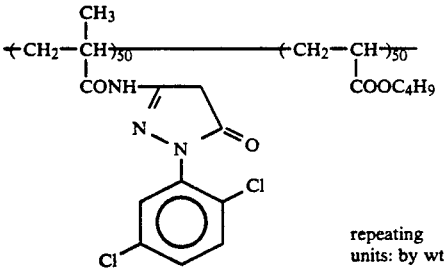

repeating units: by wt %

Average molecular weight: about 25,000

C-5

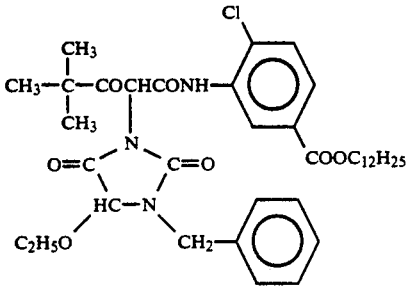

-continued

C-6

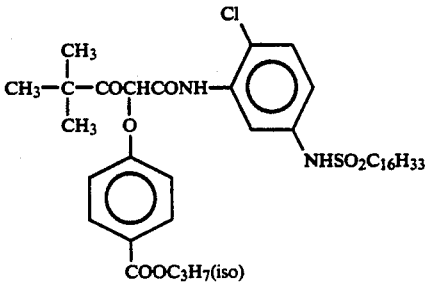

C-7

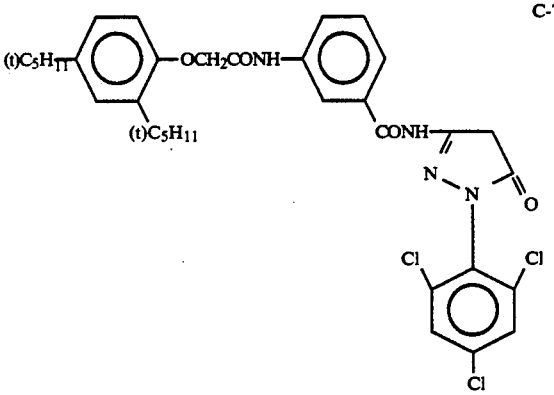

C-8

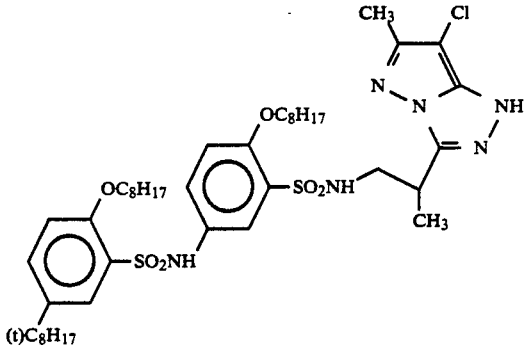

C-9

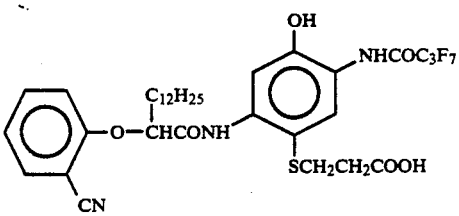

Dibutyl Phthalate — Oil-1

Tricresyl Phosphate — Oil-2

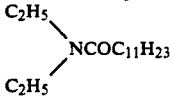

Oil-3

-continued
Cpd-A
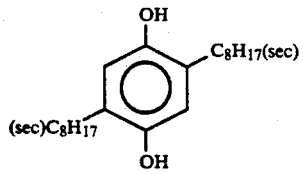
Cpd-B
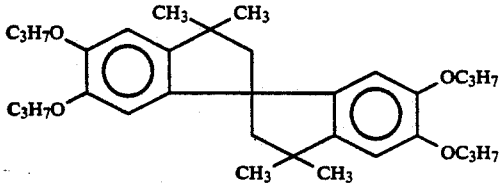
Cpd-C
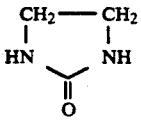
Cpd-D
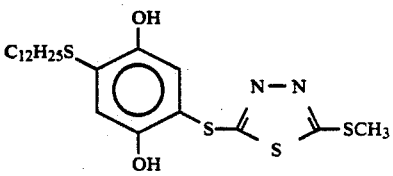
Cpd-E
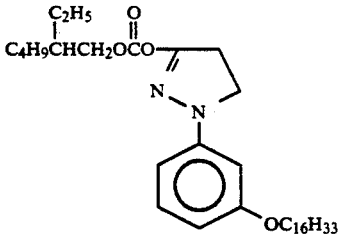
Cpd-F
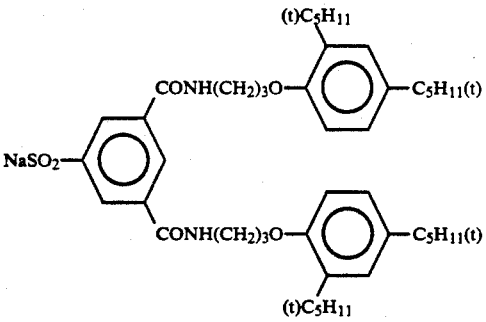
Cpd-G
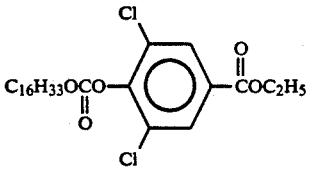
Cpd-H
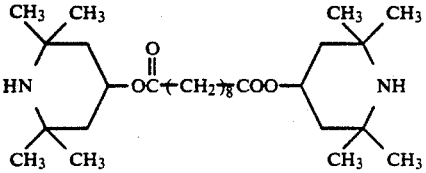
-continued
Cpd-I
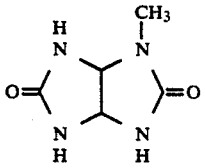
Cpd-J
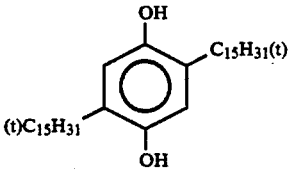
Cpd-K
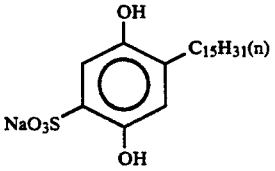
U-1
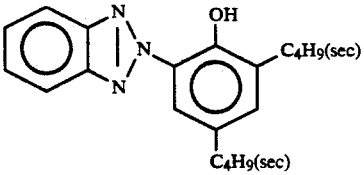
U-2
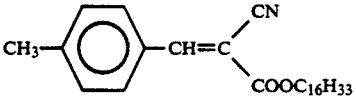
U-3
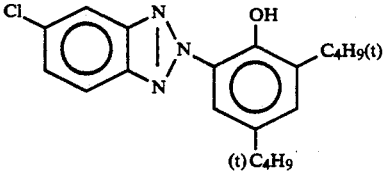
S-1
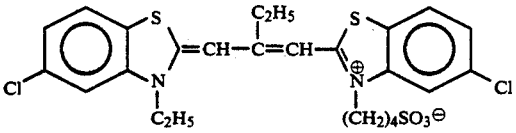
S-2
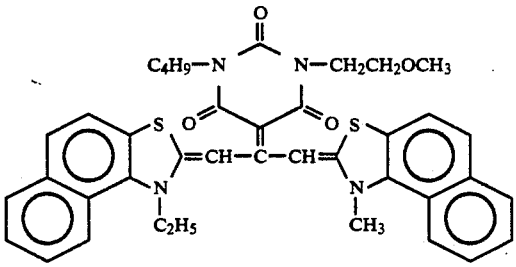
S-3
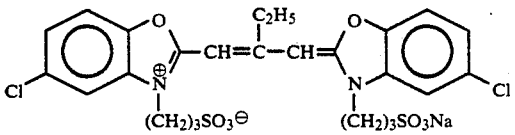

-continued
S-4
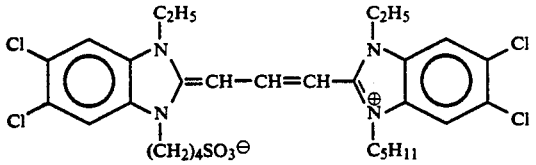
S-5
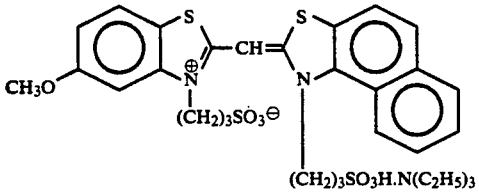
S-6
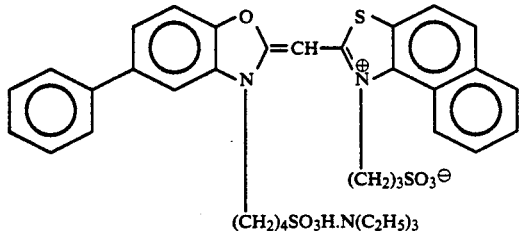
S-7
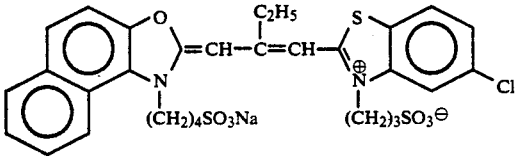
S-8
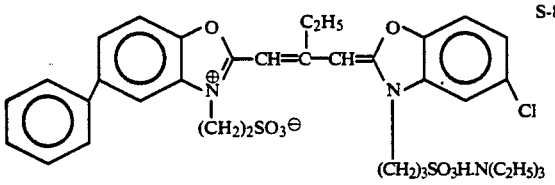
U-4
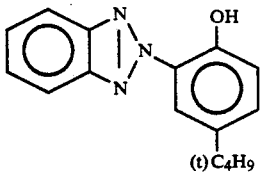
U-5
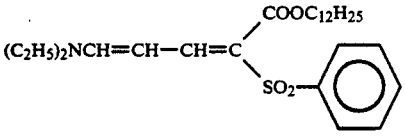
U-6
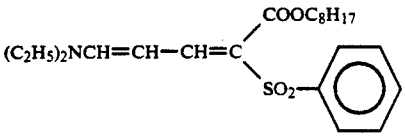
-continued
D-1
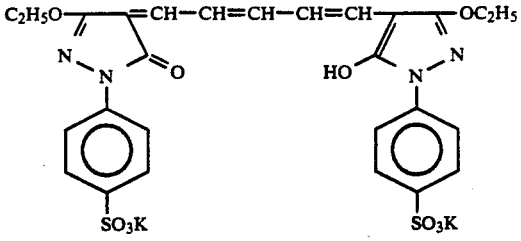
D-2
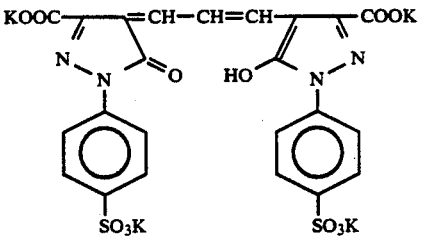
D-3
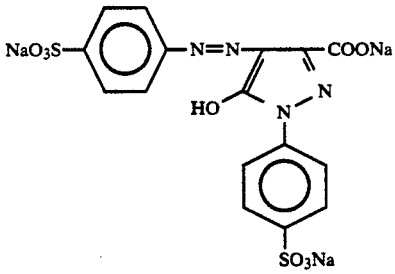
D-4
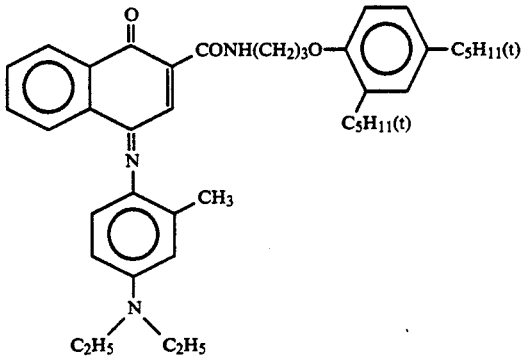
H-1
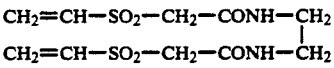
W-1
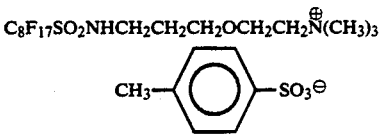
W-2
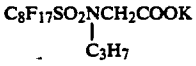
W-2
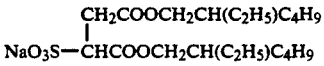
W-4
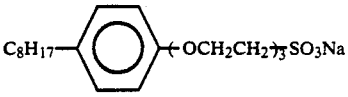

-continued

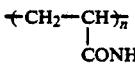

Average molecular weight: about 60,000

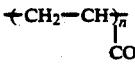

Average molecular weight: about 50,000

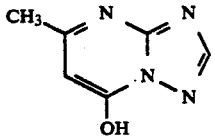

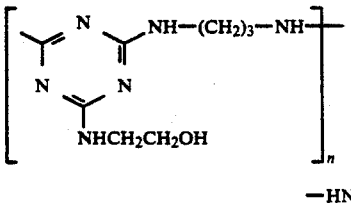

n = about 4 (average)

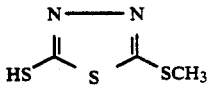

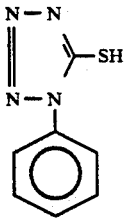

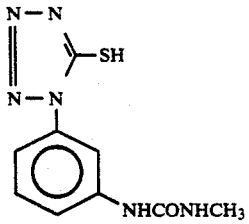

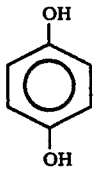

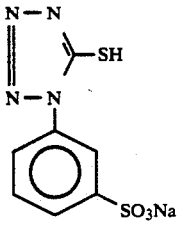

-continued

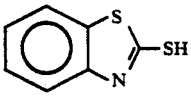

Samples 302 to 304

Other samples were prepared in the same manner as Sample 301, except that the couplers used in the fourth to sixth layers and the ninth to eleventh layers were replaced by the couplers set forth in Table 3.

Photographs of a subject considered standard were taken using the thus prepared samples, and subjected to the following photographic processing. The developed images were observed with the naked eye, and color reproduction was evaluated.

The observed results were classified in three ranks, compared with that of Sample 301. That is, they were equivalent (≈), good (◯) and superior (◎).

On the other hand, these samples were exposed to white light through an optical wedge, subjected to the following photographic processing, and then examined for light fastness. The light fastness test comprised irradiating the processed samples with a xenon lamp (200,000 lux) for 3 days and measuring the density of the magenta image area in which the density before irradiation had been 1.0.

(Photographic Processing)

| Step | Time | Temperature |
|---|---|---|
| First development | 6 min. | 38° C. |
| Washing | 2 min. | " |
| Reversal | 2 min. | " |
| Color development | 6 min. | " |
| Adjustment | 2 min. | " |
| Bleaching | 6 min. | " |
| Fixation | 4 min. | " |
| Washing | 4 min. | " |
| Stabilization | 1 min. | room temp. |
| Drying | | |

Compositions of the processing solutions used in the above-described steps are described below.

| | |
|---|---|
| First Developer: | |
| Water | 700 ml |
| Pentasodium nitrilo-N,N,N-trimethylene-phosphonate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1 wt % soln.) | 2 ml |
| Water to make | 1,000 ml |
| Reversing Bath: | |
| Water | 700 ml |
| Pentasodium nitrilo-N,N,N-trimethylene-phosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1,000 ml |
| Color Developer: | |
| Water | 700 ml |
| Pentasodium nitrilo-N,N,N-trimethylene-phosphonate | 3 g |
| Sodium sulfite | 7 g |

-continued

| | |
|---|---|
| Sodium tertiary phosphate (dodecahydrate) | 36 g |
| Potassium bromide | 1 g |
| Potassium iodide (0.1 wt % soln.) | 90 ml |
| Sodium hydroxide | 3 g |
| Citrazinic acid | 1.5 g |
| N-Ethyl-N-(β-methanesulfonamidoethyl)-3-methyl-4-aminoaniline sulfate | 11 g |
| 3,6-Dithiaoctane-1,8-diol | 1 g |
| Water to make | 1,000 ml |
| Adjusting Bath: | |
| Water | 700 ml |
| Sodium sulfite | 12 g |
| Sodium ethylenediaminetetraacetate (dihydrate) | 8 g |
| Thioglycerine | 0.4 ml |
| Glacial acetic acid | 3 ml |
| Water to make | 1,000 ml |
| Bleaching Bath: | |
| Water | 800 ml |
| Sodium ethylenediaminetetraacetate (dihydrate) | 2 g |
| Ammonium ethylenediaminetetra-acetonato-ferrate(III) (dihydrate) | 120 g |
| Potassium bromide | 100 g |
| Water to make | 1,000 ml |
| Fixing Bath: | |
| Water | 800 ml |
| Sodium thiosulfate | 80.0 g |
| Sodium sulfite | 5.0 g |
| Sodium hydrogen sulfite | 5.0 g |
| Water to make | 1,000 ml |
| Stabilizer: | |
| Water | 800 ml |
| Formaldehyde (37 wt %) | 5.0 ml |
| Fuji Dri Wel (surfactant produced by Fuji Photo Film Co., Ltd.) | 5.0 ml |
| Water to make | 1,000 ml |

TABLE 3

| Sample No. | 4th layer | 5th layer | 6th layer | 9th layer | 10th layer | 11th layer | Color reproduction | Light fastness* |
|---|---|---|---|---|---|---|---|---|
| 301 | C-1<br>C-2<br>C-9 | C-1<br>C-2<br>C-3 | C-1<br>C-3 | C-7<br>C-8 | C-7<br>C-8 | C-4<br>C-8 | control | 62% |
| 302 | C-2<br>Coupler<br>(1) | Coupler<br>(2) | Coupler<br>(10) | C-7<br>Coupler<br>II-21 | C-7<br>Coupler<br>II-21 | C-4<br>Coupler<br>II-21 | ◎ | 88% |
| 303 | C-2<br>Coupler<br>(22) | Coupler<br>(23) | Coupler<br>(1) | C-7<br>Coupler<br>II-21 | C-7<br>Coupler<br>II-21 | C-4<br>Coupler<br>II-21 | ○ | 87% |
| 304 | C-2<br>Coupler<br>(32) | Coupler<br>(32) | Coupler<br>(1) | C-7<br>Coupler<br>II-21 | C-7<br>Coupler<br>II-21 | C-4<br>Coupler<br>II-21 | ◎ | 88% |

*with respect to magenta color images

In the 4th layer of Sample 302, the amount of C-2 was the same as that of the 4th layer of Sample 301, and the amount of Coupler (1) was 62% by mole of the sum total amount of C-1 and C-9 of the 4the layer of Sample 301. In the 5th layer of Sample 302, the amount of Coupler (2) was 58% by mole of the sum total amount of C-1, C-2 and C-3 of the 5th layer of Sample 301. In the 6th layer of Sample 302, the amount of Coupler (10) was equimolar with the sum total amount of C-1 and C-3 of the 6th layer of Sample 301. In the 9th and 10th layers of Sample 302, the amount of C-7 was the same as that of the 9th or 10th layer of Sample 101, respectively, and the amount of Coupler II-21 was equimolar with the amount of C-8 of the 9th or 10th layer of Sample 301, respectively. In the 11th layer of Sample 302, the amount of C-4 was the same as that of the 11th layer of Sample 301, and the amount of Coupler II-21 was equimolar with the amount of C-8 of the 11th layer of Sample 301.

In the 4th layer of Sample 303, the amount of C-2 was the same as that of the 4th layer of Sample 301, and the amount of Coupler (22) was 62% by mole of the sum total amount of C-1 and C-9 of the 4th layer of Sample 301. In the 5th layer of Sample 303, the amount of Coupler (23) was 58% by mole of the sum total amount of C-1, C-2 and C-3 of the 5th layer of Sample 301. In the 6th layer of Sample 303, the amount of Coupler (1) was equimolar with the sum total amount of C-1 and C-3 of the 6th layer of Sample 301. In the 9th to 11th layers of Sample 303, the couplers used and the amounts thereof were the same as those of the 9th to 11th layers of Sample 302, respectively.

In the 4th layer of Sample 304, the amount of C-2 was the same as that of the 4th layer of Sample 301, and the amount of Coupler (32) was 122% by mole on monomer unit basis, of the amount of Coupler (1) of the 4th layer of Sample 302. In the 5th layer of Sample 304, the amount of Coupler (32) was 130% by mole on monomer unit basis, of the amount of Coupler (2) of the 5th layer of Sample 302. In the 6th layer of Sample 304, the coupler used and the amount thereof were the same as those of 6th layer of Sample 303. In the 9th to 11th layers of Sample 304, the couplers used and the amounts thereof were the same as these of the 9th to 11th layers of Sample 302, respectively.

As can be seen from the results in Table 3, the samples prepared in accordance with the present invention were excellent in light fastness of the magenta color image as well as color reproduction.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material which comprises on a support at least one silver halide emulsion layer which contains at least one cyan dye-forming coupler, at least one silver halide emulsion layer which contains at least one magenta dye-forming coupler, and at least one silver halide emulsion layer which contains at least one yellow dye-forming coupler, the cyan dye-forming coupler is a 1-naphthol coupler represented by formulae (Ia) or (Ib), and the magenta dye-forming coupler is a 1H-pyrazolo(1,5-b)-1,2,4-triazole type coupler:

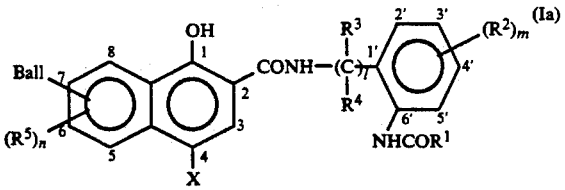

(Ia)

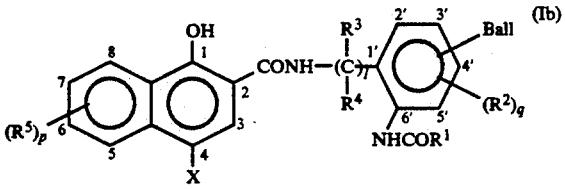

(Ib)

wherein $R^1$ represents a hydrogen atom, an alkyl group having 1 to 8 carbon atoms, an alkenyl group having 2 to 8 carbon atoms, an alkynyl group having 2 to 8 carbon atoms, a cycloalkyl group having 3 to 8 carbon atoms, an aralkyl group having 7 to 12 carbon atoms, an alkoxy group having 1 to 8 carbon atoms, an amino group having 0 to 8 carbon atoms, or an aryl group having 6 to 12 carbon atoms; $R^2$ represents a substituent group; $R^3$ and $R^4$ each represents a hydrogen atom, an alkyl group, an aryl group, a halogen atom, an alkoxy group, or an aryloxy group; $R^5$ represents a substituent group; Ball represents a ballast group; X represents a hydrogen atom, or a coupling-off group, l represents an integer from 0 to 4; m represents an integer from 0 to 4; n represents an integer from 0 to 4; q represents an integer from 0 to 3; and p represents an integer from 0 to 5.

2. A silver halide color photographic material as in claim 1, wherein the cyan dye-forming coupler-containing silver halide emulsion layer, the magenta dye-forming coupler-containing silver halide emulsion layer and the yellow dye-forming coupler-containing silver halide emulsion layer each comprises silver halide grains having a chloride content of 90 mol % or more.

3. A silver halide color photographic material as in claim 1, wherein the magenta dye-forming coupler is represented by the following formula (II):

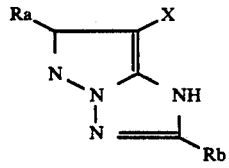

(II)

wherein Ra and Rb may be the same or different, and each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group.

4. A silver halide color photographic material as in claim 1, wherein the magenta dye-forming coupler is present in an amount of from $1\times10^{-2}$ to 1 mole per mole of silver halide.

5. A silver halide color photographic material as in claim 4, wherein the magenta dye-forming coupler is present in an amount of from $1\times10^{-1}$ to $5\times10^{-1}$ mole per mole of silver halide.

6. A silver halide color photographic material as in claim 1, wherein the yellow dye-forming coupler is an acylacetanilide coupler having an alkoxy, alkyl, aryloxy or dialkylamino group at the ortho position of the anilino group.

7. A silver halide color photographic material as in claim 1, wherein the yellow dye-forming coupler is an acylacetanilide coupler containing a 1-methylcyclopropanecarbonyl, a 1-methylcyclobutanecarbonyl or a 1-methylcyclopentanecarbonyl group as the acyl group.

8. A silver halide color photographic material as in claim 1, wherein the cyan dye-forming coupler and yellow dye-forming coupler is each present in an amount of from 0.1 to 1.0 mole per mole of silver halide.

9. A silver halide color photographic material as in claim 8, wherein the cyan dye-forming coupler and yellow dye-forming coupler is each present in an amount of from 0.1 to 0.5 mole per mole of silver halide.

* * * * *